US008214969B2

(12) United States Patent
Curtis

(10) Patent No.: US 8,214,969 B2
(45) Date of Patent: Jul. 10, 2012

(54) LAYERED ERASER

(76) Inventor: Gavin Curtis, Yonkers, NY (US)

( * ) Notice: Subject to any disclaimer, the term of this patent is extended or adjusted under 35 U.S.C. 154(b) by 776 days.

(21) Appl. No.: 12/185,207

(22) Filed: Aug. 4, 2008

(65) Prior Publication Data

US 2009/0031527 A1 Feb. 5, 2009

Related U.S. Application Data

(60) Provisional application No. 60/953,977, filed on Aug. 3, 2007.

(51) Int. Cl.
*B43L 19/00* (2006.01)

(52) U.S. Cl. ..... 15/427; 15/424

(58) Field of Classification Search ..... 15/424, 15/427; *B43L 19/00*
See application file for complete search history.

(56) References Cited

U.S. PATENT DOCUMENTS

| | | | | | |
|---|---|---|---|---|---|
| 19,783 | A | | 3/1858 | Lipman | |
| 328,778 | A | * | 10/1885 | Holton | 15/424 |
| 328,779 | A | | 10/1885 | Holton | |
| 873,327 | A | | 12/1907 | Perkins | |
| D161,423 | S | | 1/1951 | Claflin | |
| 2,874,649 | A | * | 2/1959 | Pelletier | 426/249 |
| 2,973,273 | A | | 2/1961 | Curtiss | |
| D271,344 | S | | 11/1983 | Faust | |
| D271,439 | S | | 11/1983 | Schumacher | |
| D271,534 | S | | 11/1983 | Huzinec | |
| D271,535 | S | | 11/1983 | Huzinec | |
| 294,295 | A | | 2/1984 | Whiting | |
| D279,297 | S | * | 6/1985 | Rosson | D19/53 |
| 4,755,074 | A | | 7/1988 | Roberts | |
| 4,796,328 | A | | 1/1989 | Horie | |
| D303,992 | S | | 10/1989 | Grotsch | |
| D319,846 | S | | 9/1991 | Kiyokane | |
| D366,671 | S | * | 1/1996 | Kitzmiller | D19/53 |
| D366,672 | S | | 1/1996 | Kitzmiller | |
| 5,526,548 | A | | 6/1996 | Ostrowski | |
| 5,538,742 | A | | 7/1996 | McHale et al. | |
| D377,503 | S | * | 1/1997 | Kitzmiller et al. | D19/53 |
| 5,626,892 | A | | 5/1997 | Kehoe et al. | |
| 5,955,116 | A | | 9/1999 | Kehoe et al. | |
| D424,111 | S | | 5/2000 | Bell | |
| 6,547,465 | B1 | | 4/2003 | Rago et al. | |
| 7,112,345 | B1 | | 9/2006 | McHale et al. | |

OTHER PUBLICATIONS http://www.itasho.com/.
http://www.hapaculture.com/life/kids/raishapa/erdinsr.html.
Maped product identification No. of 119510.

* cited by examiner

*Primary Examiner* — Monica Carter
*Assistant Examiner* — Stephanie Newton
(74) *Attorney, Agent, or Firm* — Harvey Lunenfeld

(57) ABSTRACT

A layered eraser, comprising: a plurality of eraser layers, comprising at least an innermost eraser layer and an outermost eraser layer; the outermost eraser layer containing the innermost eraser layer; each eraser layer adjacent at least one other eraser layer; each of the eraser layers having an outermost surface. The layered eraser may be adapted to fit about a writing instrument. Each eraser layer adjacent another eraser layer may have different shaped outermost surfaces. Embodiments include different eraser layers in the shapes of simulated space ships, simulated dinosaur heads, and simulated planets. In a preferred embodiment, the plurality of eraser layers comprise an innermost eraser layer, at least one intermediate eraser layer completely surrounding the innermost eraser layer, and an outermost eraser layer completely surrounding the at least one intermediate layer, one or more eraser layers being exposed after at least a portion of the layered eraser is worn away.

28 Claims, 22 Drawing Sheets

Fig. 38
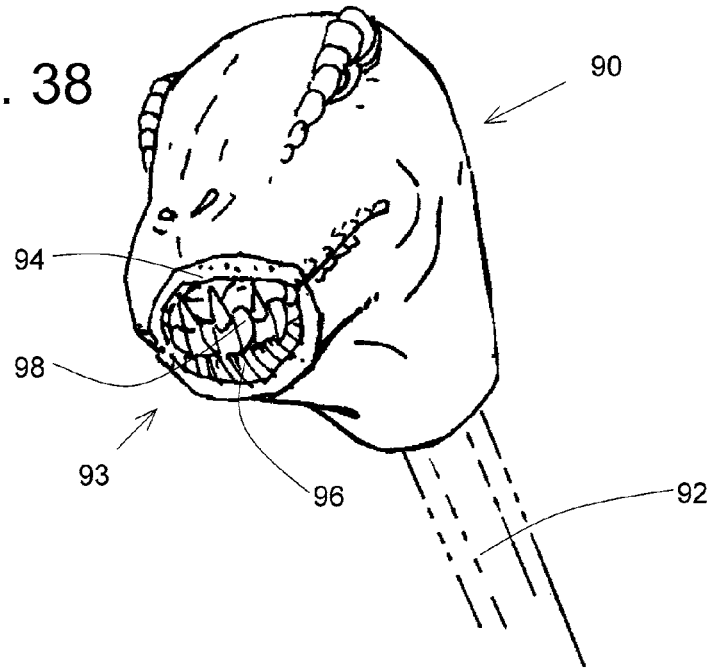
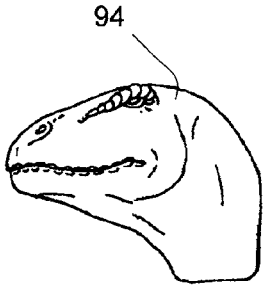
Fig. 39
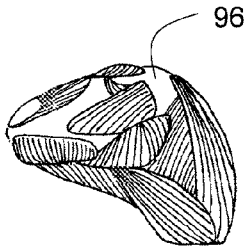
Fig. 40
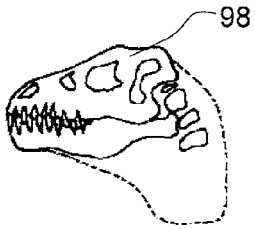
Fig. 41
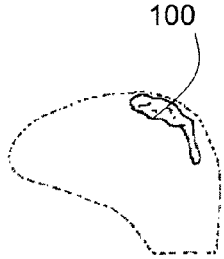
Fig. 42

LAYERED ERASER

This application claims the benefit of U.S. Provisional Application No. 60/953,977, filed Aug. 3, 2007, the full disclosure of which is incorporated herein by reference.

BACKGROUND OF THE INVENTION

1. Field of the Invention

The present invention relates generally to erasers and more particularly to layered erasers, each of the layered erasers having a core surrounded by a surface layer and/or a core surrounded by at least one intermediate layer surrounded by a surface layer.

2. Background Art

Erasers and the like have been known. Erasers are typically constructed of rubber or manmade material that allow a user to erase a mark, such as a pencil mark, ink mark, the like, or indicia from a surface. The erasers typically have a rubbery consistency, come in a variety of colors, and comprise a single layer of material, such as synthetic rubber, plastic or gum-like materials, synthetic soy-based gum, and may also contain vinyl and pulverized pumice.

Edward Naime, an English engineer, is credited with creating the first rubber eraser, using natural rubber, in 1770. However, such natural rubber erasers were not durable, were perishable, and would go bad over time. Erasers came into common use, however, after Charles Goodyear discovered the process of vulcanization in 1839, a method that cured rubber and made it durable. Hymen Lipman received the first patent on Mar. 30, 1858 (U.S. Pat. No. 19,783) for attaching an eraser to the end of a pencil; however, the patent was later invalidated.

Erasers come in several shapes and sizes. However, the more common erasers come attached to pencils, conical cap erasers that may be slipped onto the ends of pencils, block and wedge erasers that may be rectangular or block shaped, and barrel erasers contained in a barrel of a retractable cylinder. Novelty erasers are also available that have a variety of colors, shapes, and designs that are primarily intended for their decorative nature than practical use.

These erasers are typically not usable as erasers and for instructional purposes and/or entertainment, in which a user may view different layers or internal workings of an object or class of objects.

Erasers are necessary that may be used for instructional purposes and/or entertainment and that may be used practically as erasers and that have a plurality of layers that allow a user to visualize different objects and the internal structures of such objects as one or more layers are worn down are necessary. Such erasers should have a core surrounded by a surface layer and/or a core surrounded by one or more intermediate layers and a surface layer.

Layered erasers and the like that have a plurality of layers, multi layered erasers, or erasers having nested layers having an outer layer surrounding an inner core and/or an outer layer surrounding at least one intermediate layer, which surrounds an inner core are needed.

The layered erasers and the like should have a plurality of layers that typically exemplify an object or objects within a class of objects are needed. Each of the surrounding layers should have an attribute of a particular object, or each layer should be of a different object in a class of objects, or a combination thereof.

A class may be, for example, a cat; whereas, a particular cat, such as "Frisky" may be an object of the class cat. An object's attributes, may be, for example, Frisky's height, weight, and age.

Alternatively, layered erasers and the like should have a plurality of surrounding layers that represent different objects in different object classes. Different objects may be, for example, different animals, such as a dog, a cat, and a mouse.

Different erasers and the like have heretofore been known. However, none of the erasers and the like adequately satisfies these aforementioned needs.

U.S. Pat. No. 294,295 (Whiting) discloses a slate eraser having a piece of sponge or other absorbent material secured to a handle that has a water tight cup in which additional absorbent material is contained.

U.S. Pat. No. 328,778 (Holton) discloses an erasive rubber that embodies a single mass, as a block, tablet, or point composed of a number of layers or strata, alternate ones of which are made of rubber of varying quality, composition, or vulcanization, and between these layers other layers of virgin rubber or pure rubber that is slightly vulcanized are interposed, all the layers being united together by rubber cement or by virgin rubber and slight further vulcanization.

U.S. Pat. No. 328,779 (Holton) discloses a block, tablet, or mass of rubber, composed of alternate layers or strata of solid cellular rubber.

U.S. Pat. No. 873,327 (Perkins) discloses a flexible blackboard eraser, comprising a spirally wound flexible strip constituting a body having a flat top and bottom, the extreme outer end of the strip being secured to the outer edge of the body, and the coils of the spiral being otherwise disconnected, and a back formed of freely flexible material covering the entire top of the body and closing the joints between the turns of the spiral.

U.S. Pat. No. 4,755,074 (Roberts) discloses a pencil sharpener, comprising a head member having a through-opening, the head member being spherical in shape, and made of wood, plastic or metal, the outer surface of which has painted facial markings or indicia to resemble a doll's face.

U.S. Pat. No. 4,796,328 (Horie) discloses an eraser capable of erasing characters and the like written on paper with a ball-point pen, fountain pen, typewriter, word processor, color pencil or the like. The eraser has an integral structure composed of plural types of eraser pieces having different hardnesses and an abrasive material, the eraser pieces and the abrasive material existing respectively in a particulately dispersed state. A method for manufacturing such eraser comprises steps of kneading plural types of major eraser materials that have been previously vulcanized and shaped at need with an abrasive material and vulcanizing and shaping the resulting mixture. These plural types of major eraser materials are such that erasers having different hardnesses can be produced, if each of the major eraser materials is either vulcanized or heated and shaped alone, and that particles of the major eraser materials exist independently from one another even if these materials are kneaded.

U.S. Pat. No. 5,526,548 (Ostrowski) discloses an improved eraser holder on a pencil having an eraser support band that can be removed in incremental sections to provide access to additional portions of the eraser, after the original exposed portion has been worn down. Fracture lines on the band facilitate incremental removal of the sections, and the fracture lines are axially misaligned to strengthen the holder.

U.S. Pat. No. 6,547,465 (Rago, et al.) discloses a pencil with an exposable eraser. The pencil has a fixed non-replaceable eraser and a moveable sleeve. The fixed non-replaceable eraser is elongated to provide a larger eraser to pencil ratio in order to have more erase cycles per write cycles. The moveable sleeve can be moved to selectively expose a portion of the eraser. A ferrule couples the pencil body and the eraser together, and provides an outer surface to engage an inner surface of the moveable sleeve. In one embodiment, a threaded female slot in the outer surface of the ferrule engages a male threaded tab in the inner surface of the sleeve. In another embodiment, a plurality of concentric slots in the outer surface of the ferrule engage a tab in the inner surface of the sleeve.

U.S. Pat. Nos. D279,297 (Rosson), U.S. Pat. No. D319,846 (Kiyokane), and U.S. Pat. No. D424,111 (Bell) each disclose ornamental designs for erasers.

U.S. Pat. No. D366,671 (Kitzmiller) discloses an ornamental design for an eraser having a sunburst, and U.S. Pat. No. D366,672 (Kitzmiller) discloses an easer having a swirl.

U.S. Pat. No. D303,992 (Grotsch) discloses a retractable holder for an eraser or similar article.

Web site http://www.itasho.com/discloses a mini eraser collection of more than three hundred erasers, many of which can be taken apart by color, so that the erasers can be played with and assembled in different ways, parts of which are assembled separately by color.

Web site http://www.hapaculture.com/life/kids/raishapa/erdinsr.html erasers in the shapes of Sauropod, Stegosaurus, Spinosaurus, and Triceratop dinosaurs that have moveable legs and are of different colors.

Erasers are also sold by Maped, a French company. A layered eraser sold by Maped has a product identification number of 119510.

U.S. Pat. No. D161,423 (Claflin) discloses an ornamental design for a set of educational toy blocks.

U.S. Pat. No. 2,874,649 (Pelletier) discloses a process for producing candy incorporating an inset design, comprising molding a candy core having a cross section corresponding to but comprising an enlargement of the desired ultimate inset design, intimately surrounding and supporting the candy core with a candy matrix, while conforming the periphery of the surrounding matrix to a cylindrical form.

U.S. Pat. No. 2,973,273 (Curtiss) discloses a confectionary product, comprising chewing gum having a plurality of cavities thereby forming a spongy mass and a confection embodies in the cavities.

U.S. Pat. No. 5,626,892 (Kehoe, et al.) and U.S. Pat. No. 5,955,116 (Kehoe, et al.) disclose methods and apparatus for production of multi-flavored and multi-colored chewing gum, in which multi-veined chewing gum is produced by injecting a plurality of different liquid flavor/dye compositions into a substantially homogeneous gum base composition or into a laminated or coextruded gum composition. In embodiments of the invention substantially straight longitudinal veins of color are partially mixed to partially displace colored veins in a direction transverse to the direction of extrusion, so as to create veined, multi-colored patterns substantially throughout a cross section of the product in a manner such that the multi-colored patterns in the cross-section differ along the length of the extrudate. The extrudate is cut to obtain gum pieces having different veins of injected liquid additives, which provide a swirled or marbleized pattern in the opposing cut ends. The injected liquid additive compositions may include flavors, dyes, lakes, high intensity sweeteners, therapeutic agents, breath freshening agents, and mixtures thereof. Surface veins may also be produced by injection of liquid colorant/flavorant compositions onto the substantially homogeneous gum base composition, as it passes through the extrusion head barrel. The surface veins may be disrupted or displaced independently of the interior veins, using a rotatable sleeve or gum rope twisting device.

U.S. Pat. No. 5,538,742 (McHale, et al.) and U.S. Pat. No. 7,112,345 (McHale, et al.) disclose a multi-phase sheeted chewing gum and a method and apparatus for making the multi-phase sheeted chewing gum that includes a first mass of a chewing gum formed in a generally flat sheet and a second mass of a confectionery product having a different color than the first mass. The second mass is smaller than the first mass and is embedded in the first mass, so as to be visible with the first mass from the top surface of the chewing gum. The method includes the steps of forming the first mass into a slab with a generally flat surface. The second mass is formed into at least one piece, which is brought into contact with the flat surface. The slab and the piece are pressed to produce a generally flat sheet, which is cut into segments of desired width, length and shape.

U.S. Pat. Nos. D271,344 (Faust), U.S. Pat. No. D271,439 (Schumacher), U.S. Pat. No. D271,534 (Huzinec), and U.S. Pat. No. D271,535 (Huzinec) each disclose ornamental designs for two color chewing gum.

For the foregoing reasons, there is a need for a layered eraser that may be used for instructional purposes and/or entertainment, in which a user may view different layers or internal workings of an object or class of objects. Erasers are necessary that may be used for instructional purposes and/or entertainment and that may be used practically as erasers and that have a plurality of layers that allow a user to visualize different objects and the internal structures of such objects as one or more layers are worn down are necessary. Such erasers should have a core surrounded by a surface layer and/or a core surrounded by one or more intermediate layers and a surface layer.

Layered erasers and the like that have a plurality of layers, multi layered erasers, or erasers having nested layers having an outer layer surrounding an inner core and/or an outer layer surrounding at least one intermediate layer, which surrounds an inner core are needed.

The layered erasers and the like should have a plurality of layers that typically exemplify an object or objects within a class of objects are needed. Each of the surrounding layers should have an attribute of a particular object, or each layer should be of a different object in a class of objects, or a combination thereof. Alternatively, layered erasers and the like should have a plurality of surrounding layers that represent different objects in different object classes.

SUMMARY

The present invention is directed to a layered eraser having a core surrounded by a surface layer and/or a core surrounded by at least one intermediate layer surrounded by a surface layer. The layered eraser may be used for instructional purposes and/or entertainment, in which a user may view different layers or internal workings of an object or class of objects. The layered eraser may be used for instructional purposes, for entertainment, and as an eraser, and has a plurality of layers that allow a user to visualize different objects and the internal structures of such objects as one or more layers are worn down. The layered eraser has a core surrounded by a surface layer or outermost layer and/or a core surrounded by one or more intermediate layers and a surface layer or outermost layer.

Erasers having a plurality of layers may be considered to be layered erasers, multi layered erasers, or erasers having nested layers having an outer layer surrounding an inner core and/or an outer layer surrounding at least one intermediate layer, which surrounds an inner core.

The layered eraser has a plurality of layers that typically exemplifies an object or objects within a class of objects. Each of the surrounding layers has an attribute of a particular object, or each layer may be of a different object in a class of objects, or a combination thereof.

A class may be, for example, a cat; whereas, a particular cat, such as "Frisky" may be an object of the class cat. An object's attributes, may be, for example, Frisky's height, weight, and age.

Alternatively, the layered eraser may have a plurality of surrounding layers that represent different objects in different object classes.

Different objects may be, for example, different animals, such as a dog, a cat, and a mouse.

Alternatively, different layers of the layered eraser may represent different themes, or the different layers may be thematically based.

In an embodiment of the present invention, a layered eraser, comprises: a plurality of layers, the plurality of layers having an innermost layer and an outermost layer, the outermost layer containing the innermost layer, the innermost layer having an innermost interior surface and an innermost exterior surface, the outermost layer having an outermost interior surface and an outermost exterior surface, the innermost exterior surface adjacent the outermost interior surface, the innermost exterior surface and the outermost exterior having a different shape one from the other, a portion of the outermost interior surface adapted to be mounted to a writing instrument.

Each of the plurality of layers comprises a different eraser layer that may be used to erase a mark, such as a pencil mark, ink mark, the like, or indicia from a surface. Portions of different layers of the layered eraser are exposed and become visible, as the eraser is being used and worn down.

In another embodiment of the present invention, a layered eraser, comprises: a plurality of layers, the plurality of layers having an innermost layer and an outermost layer, the innermost layer having an innermost interior surface and an innermost exterior surface, at least one intermediate layer having at least one intermediate interior surface and at least one intermediate exterior surface, the outermost layer surrounding the at least one intermediate layer, the at least one intermediate layer surrounding the innermost layer, the outermost layer having an outermost interior surface and an outermost exterior surface, the innermost exterior surface adjacent the at least one intermediate interior surface, the at least one intermediate exterior surface adjacent the outermost interior surface, the innermost exterior surface and the outermost exterior having a different shape one from the other, a portion of the outermost interior surface adapted to be mounted to a writing instrument.

The portion of the outermost interior surface, which is adapted to be mounted to the writing instrument, typically has a partially hollow receiving portion to receive or be mounted to the top of a pencil or pen, although other suitable arrangements for mounting the layered eraser to a writing instrument may be used.

The multi-layered eraser may be also be used by itself, rather than being mounted on a writing instrument and have a solid core.

In another embodiment of the present invention, a layered eraser, comprises: a plurality of layers, the plurality of layers having an innermost layer and an outermost layer, the outermost layer containing the innermost layer, the innermost layer having an innermost exterior surface, the outermost layer having an outermost interior surface and an outermost exterior surface, the innermost exterior surface adjacent the outermost interior surface, the innermost exterior surface and the outermost exterior having a different shape one from the other.

In another embodiment of the present invention, a layered eraser, comprises: a plurality of layers, the plurality of layers having an innermost layer and an outermost layer, the innermost layer having an innermost exterior surface, at least one intermediate layer having at least one intermediate interior surface and at least one intermediate exterior surface, the outermost layer surrounding the at least one intermediate layer, the at least one intermediate layer surrounding the innermost layer, the outermost layer having an outermost interior surface and an outermost exterior surface, the outermost layer having an outermost interior surface and an outermost exterior surface, the innermost exterior surface adjacent the at least one intermediate interior surface, the at least one intermediate exterior surface adjacent the outermost interior surface, the innermost exterior surface and the outermost exterior having a different shape one from the other.

In addition to a variety of different shapes of the layers of the multi-layered erasers, the layers may be of different colors, textures pigments, and/or a combination of colors, textures, and/or pigments.

A molding process is also shown. Suitable material for fabricating a layer or layers of the layered eraser is poured into a mold. A mold is cut after it has cured to remove a particular layer from the mold. Clamping means or their equivalent are used to keep the two halves of the mold together. Upon fabrication of a particular layer or layers, the two halves of the mold may be separated, and the layer or layers fabricated therein may be removed. When the layered eraser has cured, the layered eraser may be removed from the mold.

A layered eraser having features of the present invention comprises: a plurality of layers, the plurality of layers having an innermost layer and an outermost layer, the innermost layer having an innermost exterior surface, at least one intermediate layer having at least one intermediate interior surface and at least one intermediate exterior surface, the outermost layer surrounding the at least one intermediate layer, the at least one intermediate layer surrounding the innermost layer, the outermost layer having an outermost interior surface and an outermost exterior surface, the outermost layer having an outermost interior surface and an outermost exterior surface, the innermost exterior surface adjacent the at least one intermediate interior surface, the at least one intermediate exterior surface adjacent the outermost interior surface, the innermost exterior surface and the outermost exterior having a different shape one from the other.

A layered eraser having features of the present invention also comprises: a plurality of eraser layers, comprising at least an innermost eraser layer and an outermost eraser layer; the outermost eraser layer containing the innermost eraser layer; each eraser layer of the plurality of eraser layers adjacent at least one other eraser layer; each of the eraser layers having an outermost surface. The layered eraser may be adapted to fit about a writing instrument. In a preferred embodiment, each eraser layer adjacent another eraser layer has a different shaped outermost surface. Embodiments include different eraser layers in the shape of simulated space ships, different shaped simulated dinosaur heads, and different shaped simulated planets. In a preferred embodiment, the plurality of eraser layers comprise an innermost eraser layer, at least one intermediate eraser layer surrounding the innermost eraser layer, and an outermost eraser layer surrounding the at least one intermediate layer.

DRAWINGS

These and other features, aspects, and advantages of the present invention will become better understood with regard to the following description, appended claims, and accompanying drawings where:

Figure 29:
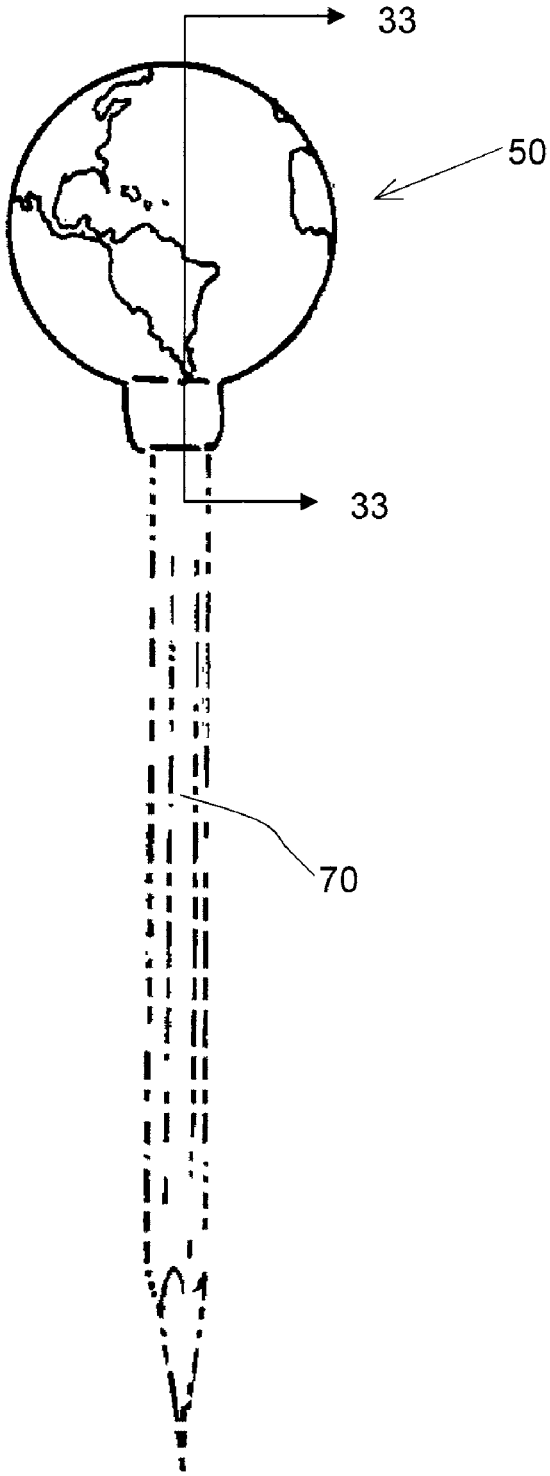
FIG. 29 is a front view of an alternate embodiment of a layered eraser, showing a globe simulating the Earth's crust mounted on a pencil, the pencil being shown in phantom.
Figure 30:
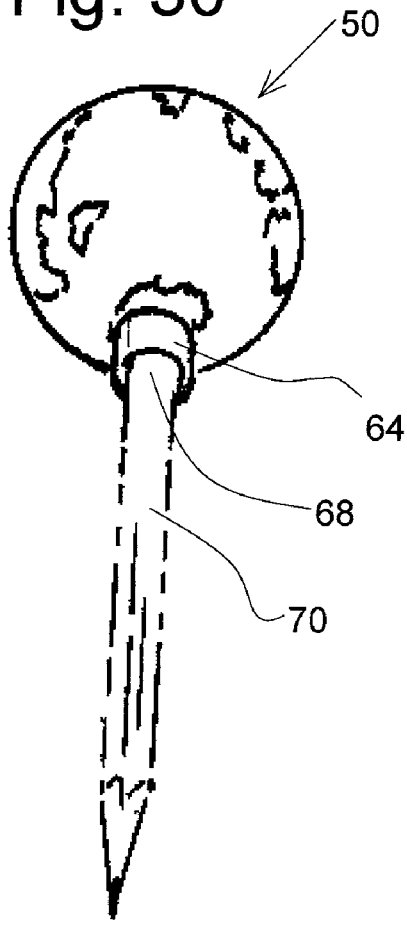
FIG. 30 is a perspective view of the layered eraser of FIG. 29 shown mounted on the pencil, the pencil being shown in phantom.
Figure 31:
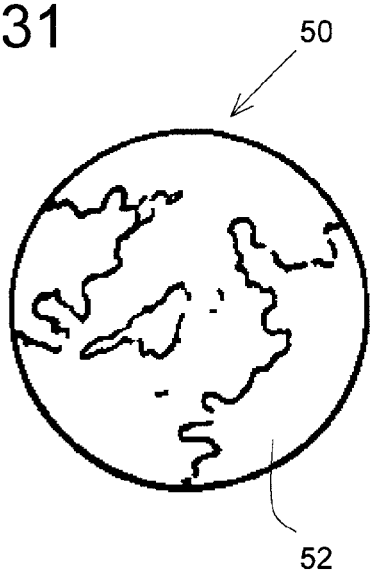
FIG. 31 is a top view of the layered eraser of FIG. 29.
Figure 32:
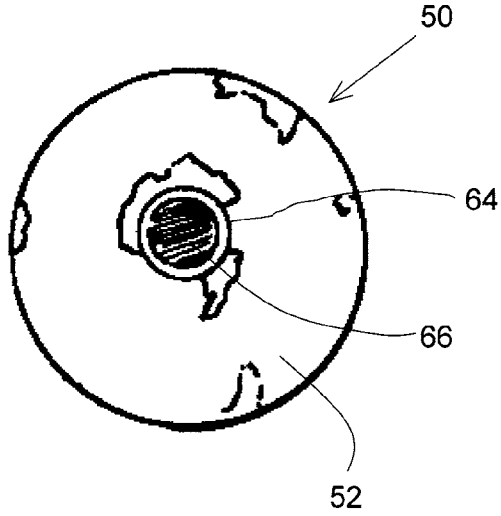
FIG. 32 is a bottom view of the layered eraser of FIG. 29.
Figure 33:
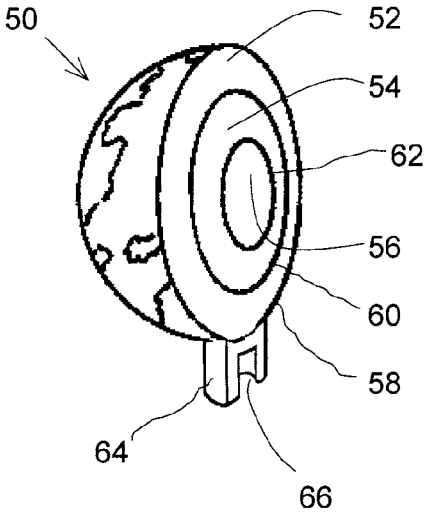
FIG. 33 is a cross section view of the layered eraser of FIG. 29 showing an innermost layer, an intermediate layer, and an outermost layer of the layered eraser.
Figure 34:
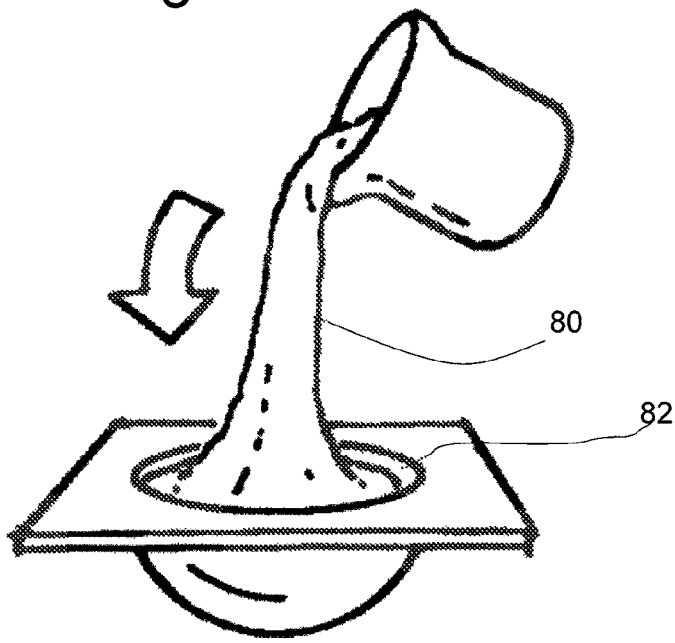
Figure 35:
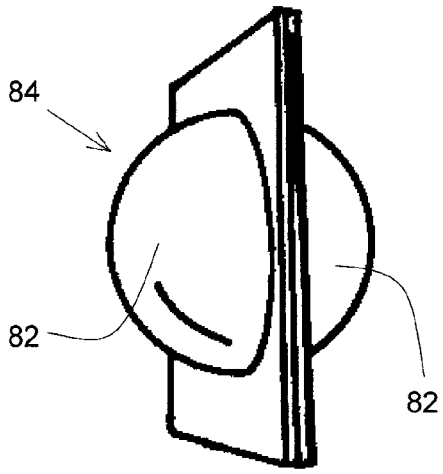
Figure 36:
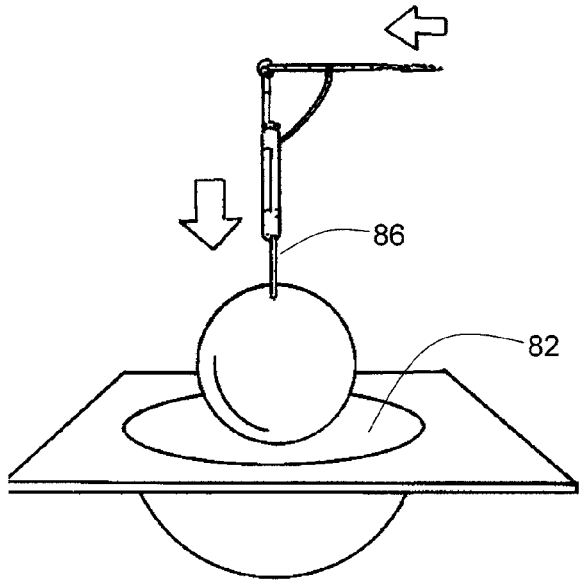
Figure 37:
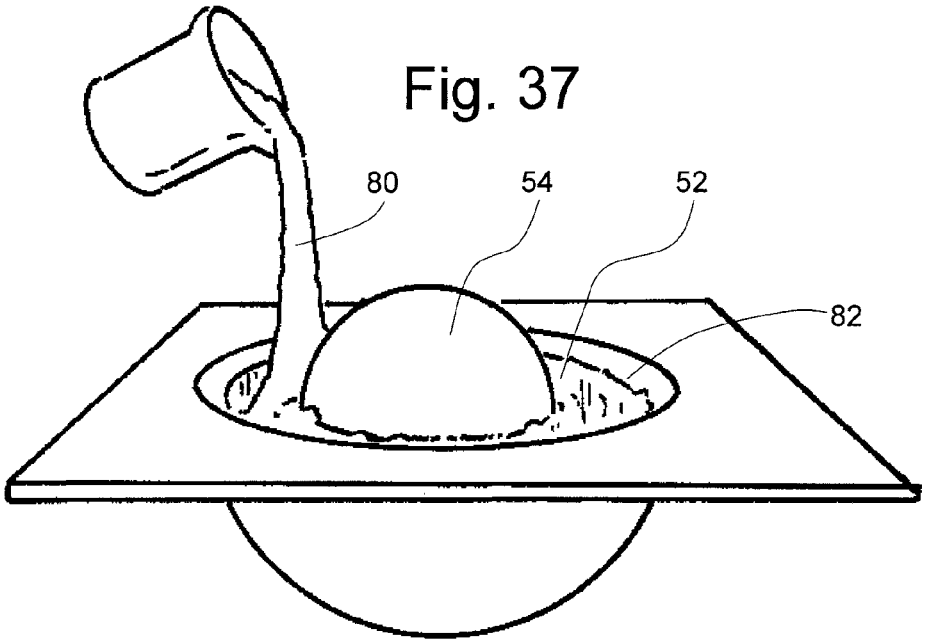
Figure 43:
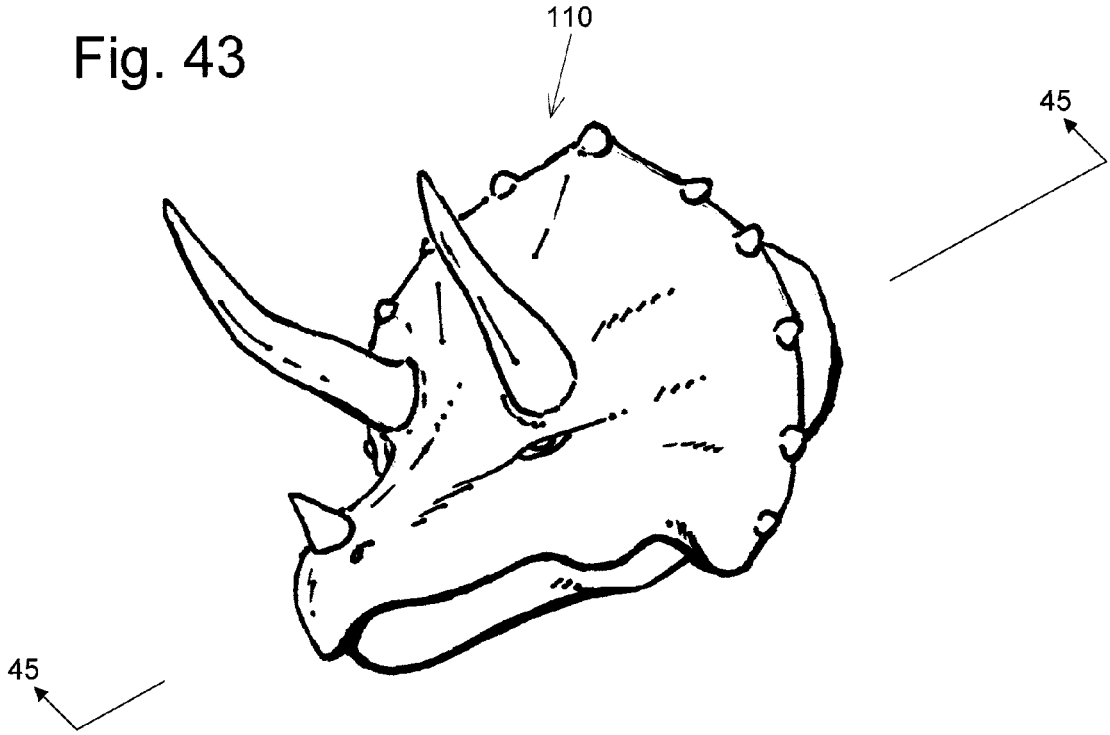
Figure 44:
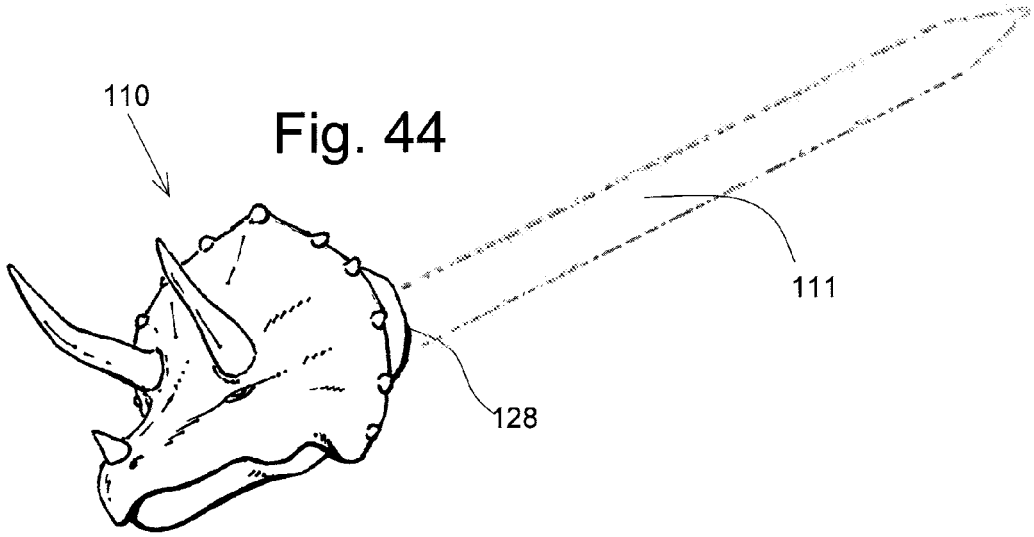
Figure 45:
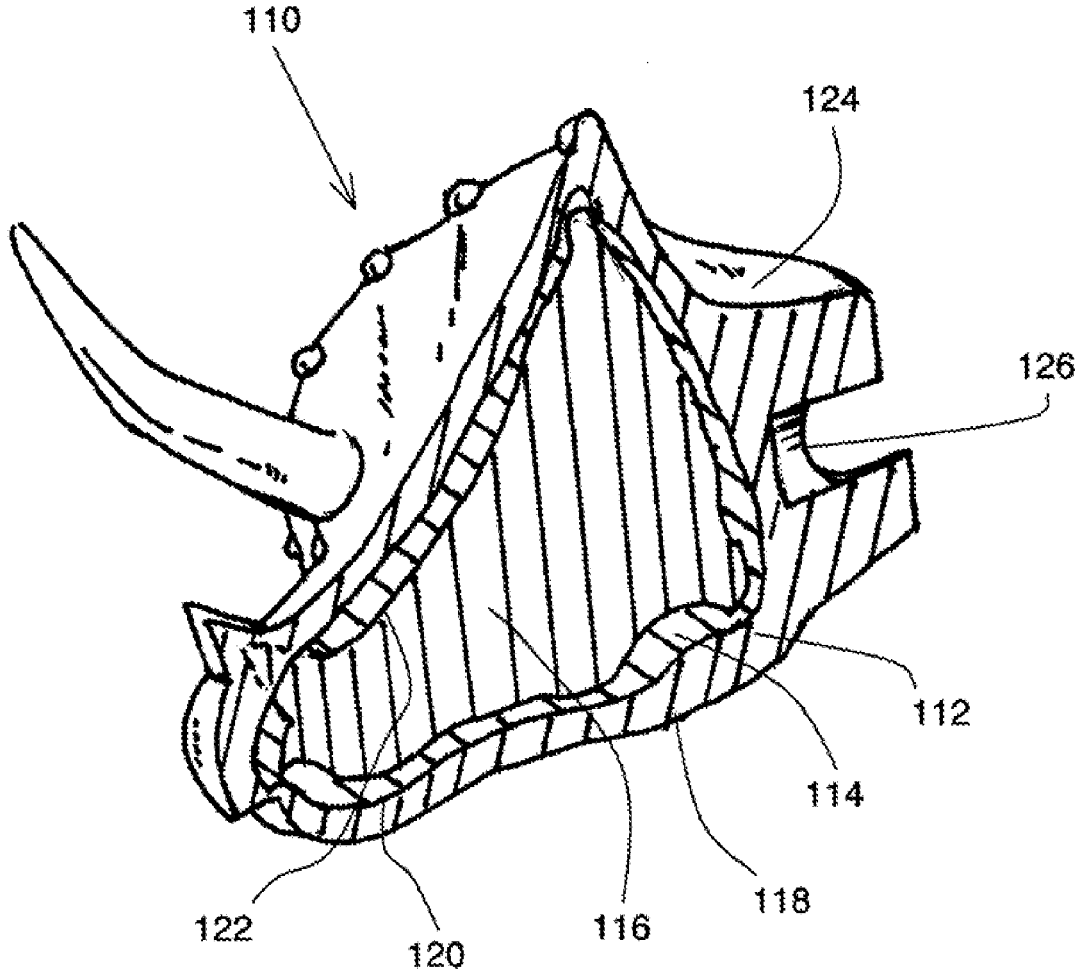
Figure 46:
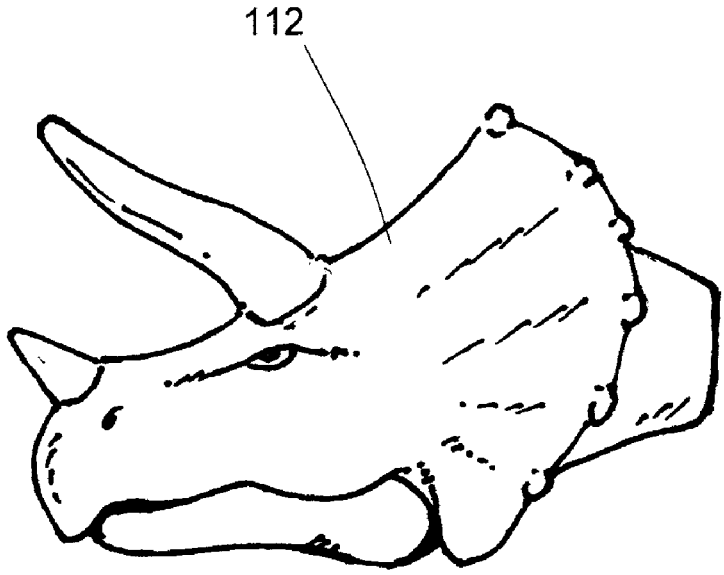
Figure 47:
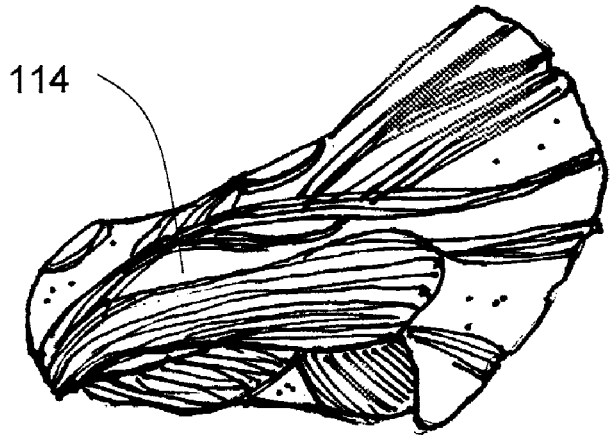
Figure 48:
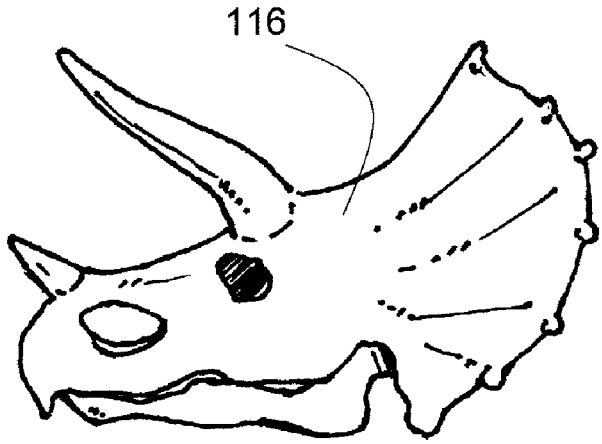
Figure 49:
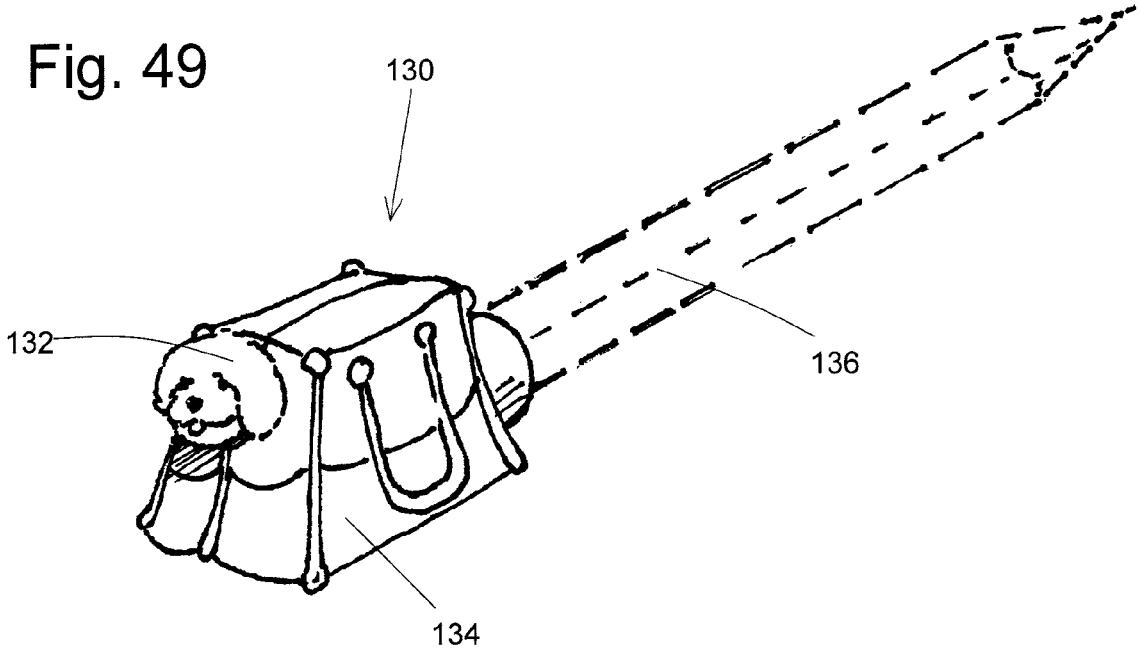
Figure 50:
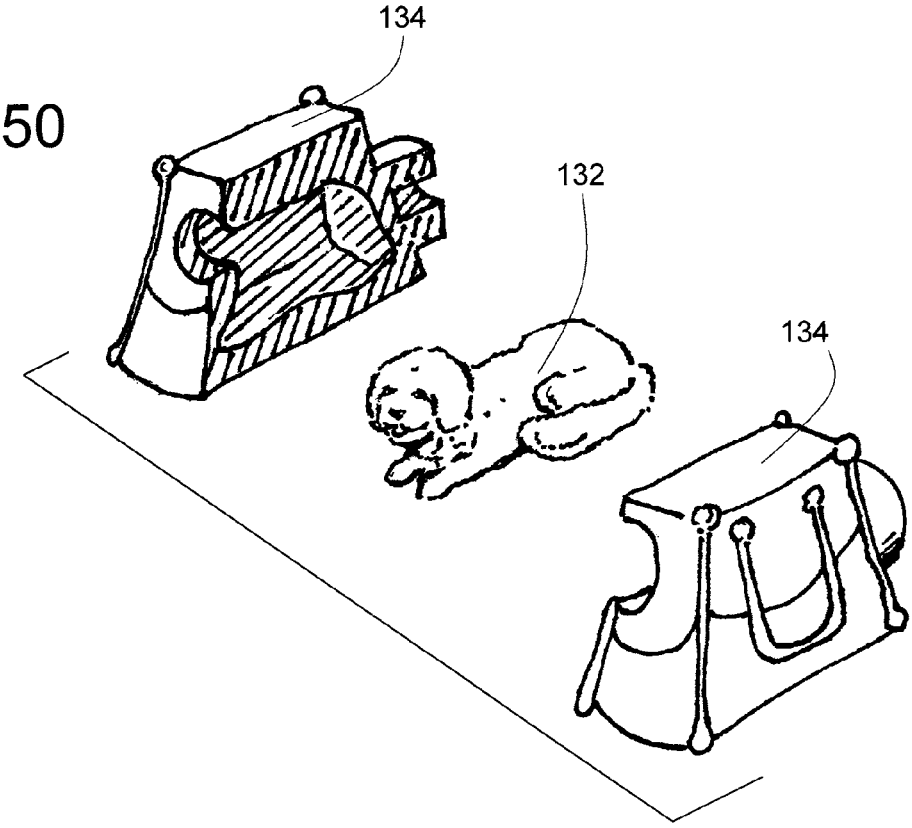
Figure 51:
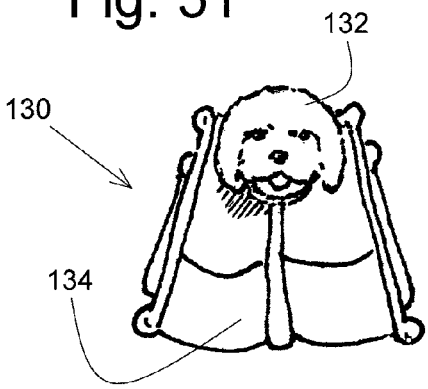
Figure 52:
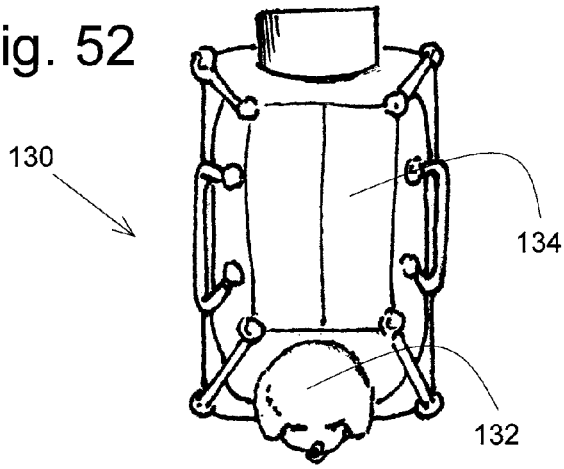
Figure 53:
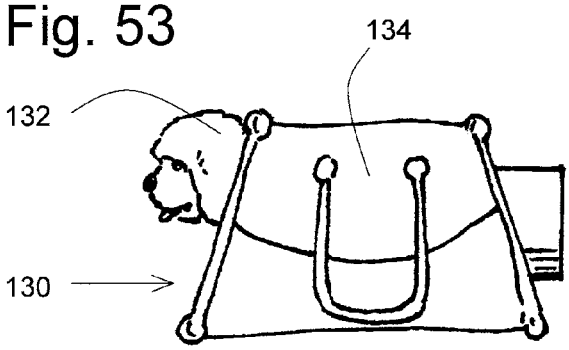
Figure 54:
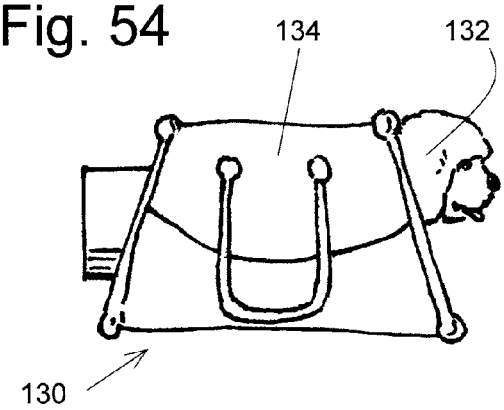
Figure 55:
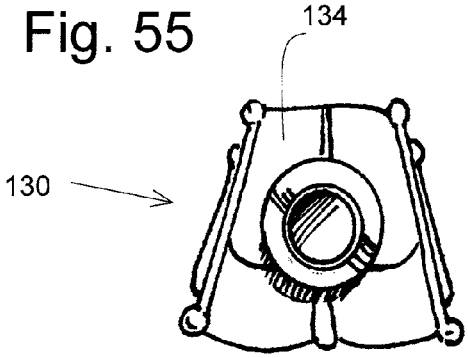

FIG. 34 a perspective view of the layered eraser of FIG. 29 being fabricated;

FIG. 35 a perspective view of a mold for fabricating the layered eraser of FIG. 29;

FIG. 36 a perspective view of a device for nesting different layers of the layered eraser of FIG. 29;

FIG. 37 is a perspective view of the outermost layer of the layered eraser of FIG. 29 being fabricated about the intermediate layer of the layered eraser;

FIG. 38 is a perspective view of an alternate embodiment of a layered eraser, showing a simulated T-Rex dinosaur head mounted on a portion of a pencil, the portion of the pencil being shown in phantom, and mouth portion of the layered eraser worn away;

FIG. 39 is a side view of an epidermis layer of the layered eraser of FIG. 38;

FIG. 40 is a side view of a musculature layer of the layered eraser of FIG. 38;

FIG. 41 is a side view of a skeletal layer of the layered eraser of FIG. 38 showing the epidermis layer in outline;

FIG. 42 is a side view of a brain layer of the layered eraser of FIG. 38 showing the epidermis layer in outline;

FIG. 43 is a perspective view of an alternate embodiment of a layered eraser, showing a simulated Triceratops dinosaur head;

FIG. 44 is a perspective view of the layered eraser of FIG. 43 mounted on a portion of a pencil, the portion of the pencil being shown in phantom;

FIG. 45 is a perspective cross section view of the layered eraser of FIG. 43 showing an outermost layer, an intermediate layer, and an innermost layer of the layered eraser;

FIG. 46 is a side view of the outermost layer of the layered eraser of FIG. 43;

FIG. 47 is a side view of the intermediate layer of the layered eraser of FIG. 43;

FIG. 48 is a side view of the innermost layer of the layered eraser of FIG. 43;

FIG. 49 is a perspective view of an alternate embodiment of a layered eraser, showing a simulated dog in a simulated carrying case mounted on a pencil, the pencil being shown in phantom;

FIG. 50 is an exploded view of the layered eraser of FIG. 49;

FIG. 51 is a front view of the layered eraser of FIG. 49;

FIG. 52 is a top view of the layered eraser of FIG. 49;

FIG. 53 is a side view of the layered eraser of FIG. 49;

FIG. 54 is another side view of the layered eraser of FIG. 49;

FIG. 55 is a rear view of the layered eraser of FIG. 49; and

Figure 56:
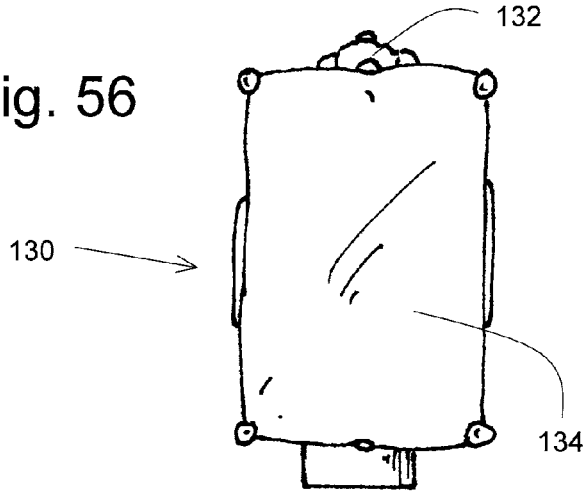

FIG. 56 is a bottom view of the layered eraser of FIG. 49.

DESCRIPTION

The preferred embodiments of the present invention will be described with reference to FIGS. 1-56 of the drawings. Identical elements in the various figures are identified with the same reference numbers.

Figure 1:
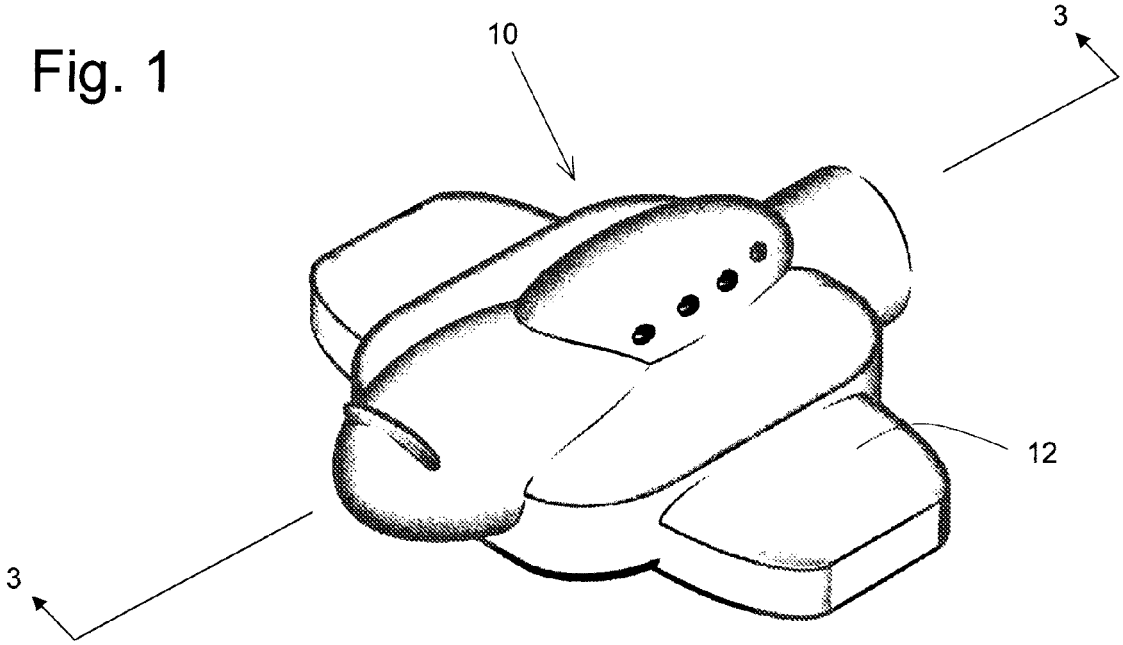
FIG. 1 is a perspective view of a layered eraser, showing a simulated space ship, constructed in accordance with the present invention, which shows an outermost layer of the layered eraser.

FIGS. 1-56 show embodiments of the present invention, which are layered erasers each of which has a plurality of eraser layers. In the embodiments shown, each of the layered erasers has an innermost layer, an outermost layer, and an optional intermediate layer nested between the innermost layer and the outermost layer, although other suitable layers may be used. The layered erasers may have two or more layers, depending upon the application selected.

The outermost layer, which may be considered to be the surface layer, contains or surrounds the optional intermediate layer and the innermost layer, which may be considered to be the core. The outermost layer, or the surface layer, surrounds the innermost layer, or the core, when the layered eraser has two layers. When the layered eraser has more than two layers: the outermost layer, or the surface layer, surrounds at least one intermediate layer; and the at least one intermediate layer surrounds the innermost layer, or the core.

Each of the layered erasers may have an optional chamber adapted to mount the layered eraser to a writing instrument.

FIGS. 1-28 show an embodiment of the present invention, a layered eraser 10 having an outermost layer 12, an intermediate layer 14, and an innermost layer 16. The outermost layer 12, the intermediate layer 14, and the innermost layer 16 are each in the form of different simulated space ships. The outermost layer 12 of the layered eraser 10 has outermost layer surface 18 having the shape of a first simulated space ship; the intermediate layer 14 of the layered eraser 10 has intermediate layer surface 20 having the shape of a second simulated space ship; and the innermost layer 16 of the layered eraser 10 has innermost layer surface 22 having the shape of a third simulated space ship. The innermost layer 16 is nested within the intermediate layer 14, and the intermediate layer 14 is nested within the outermost layer 12.

The outermost layer 12 surrounds the intermediate layer 14, and the intermediate layer 14 surrounds the innermost layer 16. The outermost layer 12 may be considered to be the surface layer of the layered eraser 10. The innermost layer 16 may be considered to be core of the layered eraser 10.

The layered eraser 10 has substantially cylindrical end portion 24 and substantially cylindrical chamber 26 for optionally receiving top portion 28 of pencil 30 therein and mounting on the pencil 30. The substantially cylindrical end portion 24 and/or the substantially cylindrical chamber 26 may have other suitable shapes for mounting to the top of the pencil 30. Alternatively, the substantially cylindrical end portion 24 of the layered eraser 10 may be adapted to fit into or on top of other suitable or alternative pencils. The substantially cylindrical chamber 26 of the layered eraser 10 may be adapted to fit about, on top of, or to cap the pencil 30, a pen, or other suitable writing instrument or other suitable instrument, or alternatively be conical shaped or have another suitable shape to fit about, on top of, or to cap the pencil 30, a pen, or other suitable writing instrument or other suitable instrument.

Adjacent layers of the plurality of eraser layers of the layered eraser 10 typically have distinguishing features, characteristics, and/or properties that are different from each other, in order to distinguish each of the plurality of layers from each other. The adjacent layers of the plurality of eraser layers of the layered eraser 10 may be of different colors, textures, pigments, be of different materials, and have other suitable means, and/or any combination thereof, in order to distinguish the adjacent layers from each other. Thus, as the layered eraser 10 wears down from use, one or more layers of the plurality of layers of the layered eraser 10 become exposed.

The outermost layer 12 and the intermediate layer 14 may, for example, be of different colors, textures, pigments, be of different materials, have other suitable means, and/or any combination thereof, in order to distinguish the outermost layer 12 and the intermediate layer 14 from each other. The intermediate layer 14 and the innermost layer 16 may, for example, be of different colors, textures, pigments, be of different materials, have other suitable means, and/or any combination thereof, in order to distinguish the intermediate layer 14 and the innermost layer 16 from each other. Other suitable means may, however, be used to distinguish the different layers one from the other.

Figure 2:
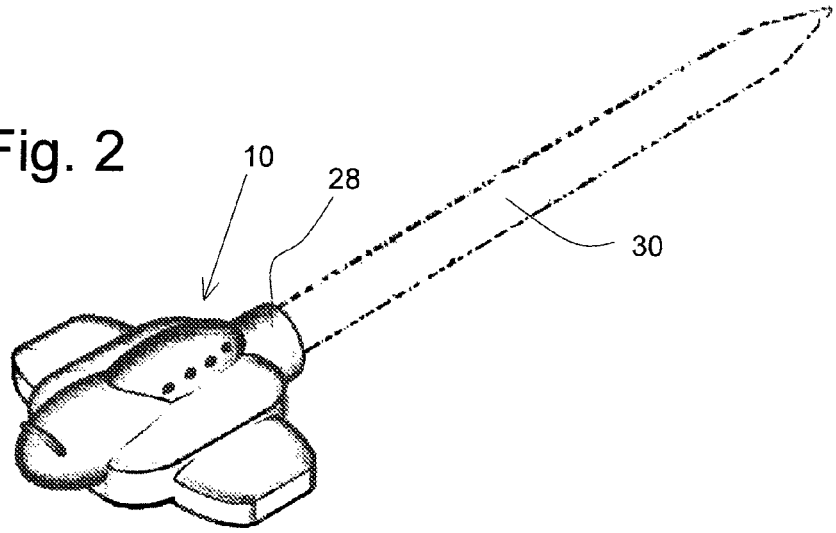
FIG. 2 is a perspective view of the layered eraser of FIG. 1 mounted on a pencil; the pencil being shown in phantom.

FIG. 1 shows the layered eraser 10, constructed in accordance with the present invention, showing the outermost layer 12 of the layered eraser 10. FIG. 2 shows the layered eraser 10 mounted on the pencil 30.

Figure 3:
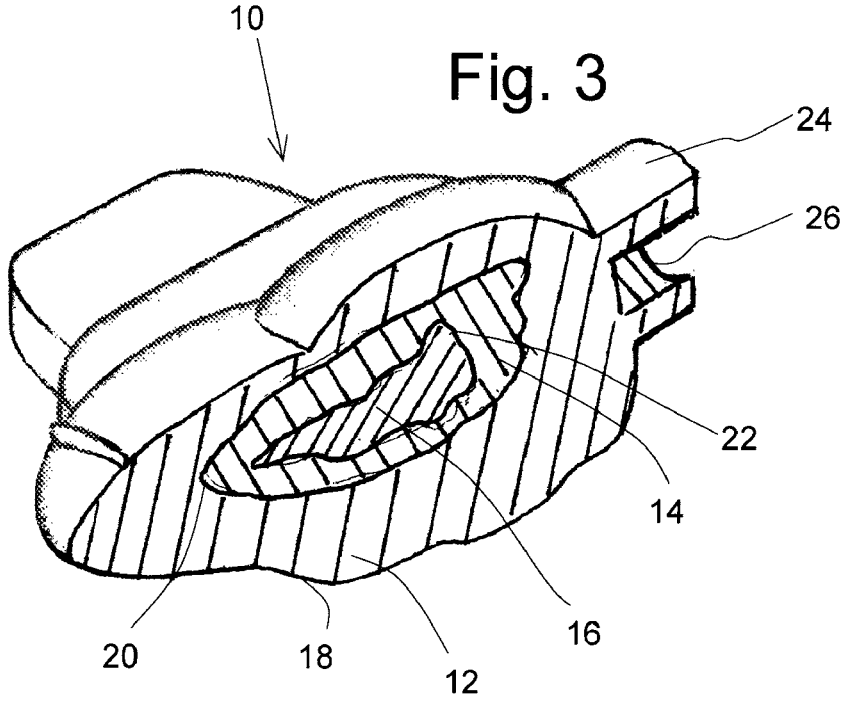
FIG. 3 is a perspective cross section view of the layered eraser of FIG. 1 showing an outermost layer, an intermediate layer, and an innermost layer of the layered eraser.

FIG. 3 shows a cross section view of the layered eraser 10, which shows the outermost layer 12, the intermediate layer 14, the innermost layer 16, the outermost layer surface 18, the intermediate layer surface 20, and the innermost layer surface 22, respectively, having the shape of the first simulated space ship, the shape of the second simulated space ship, and the shape of the third simulated space ship, respectively. FIG. 3 also shows the substantially cylindrical end portion 24 and the substantially cylindrical chamber 26 that may optionally be used to mount the layered eraser 10 to the top portion 28 of the pencil 30.

Figure 4:
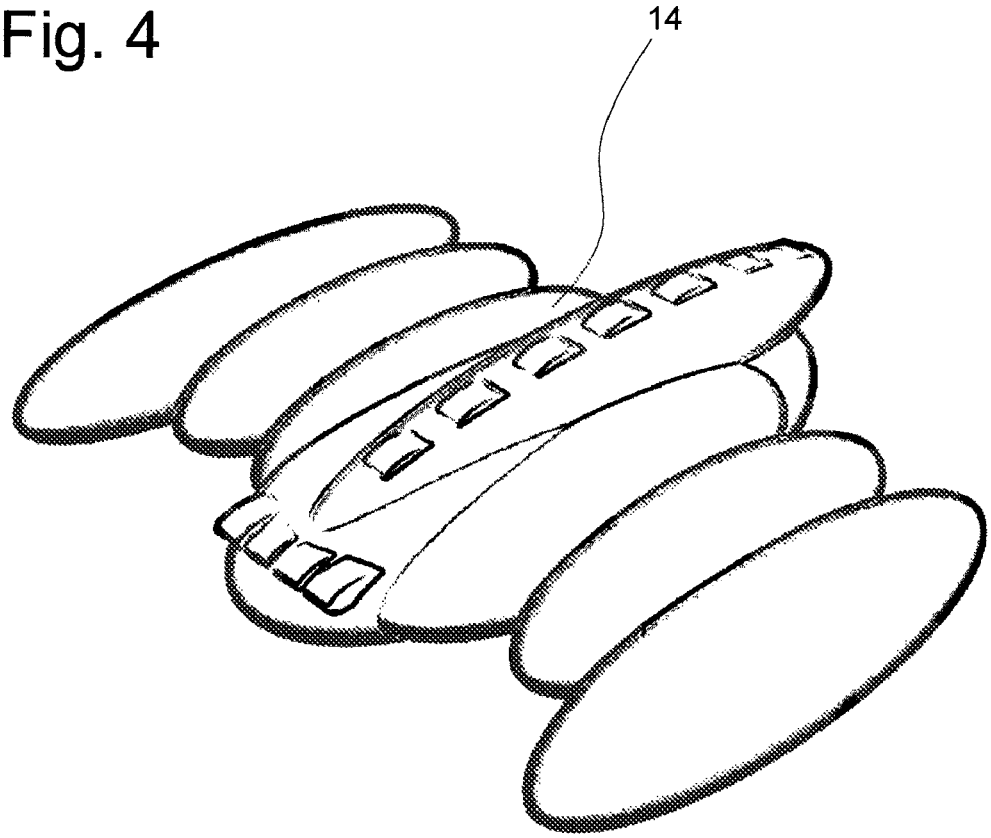
FIG. 4 is a perspective view of the intermediate layer of the layered eraser of FIG. 1.
Figure 5:
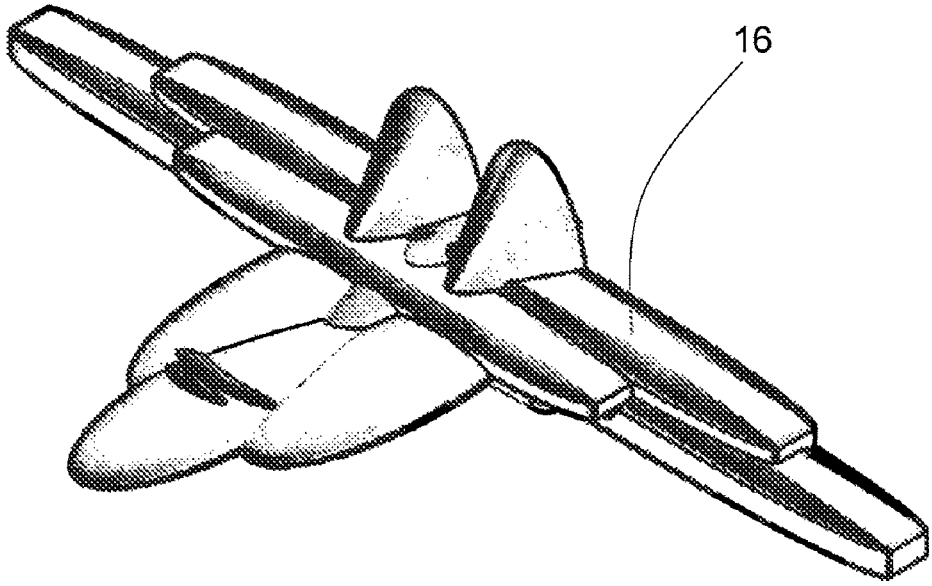
FIG. 5 is a perspective view of the innermost layer of the layered eraser of FIG. 1.
Figure 6:
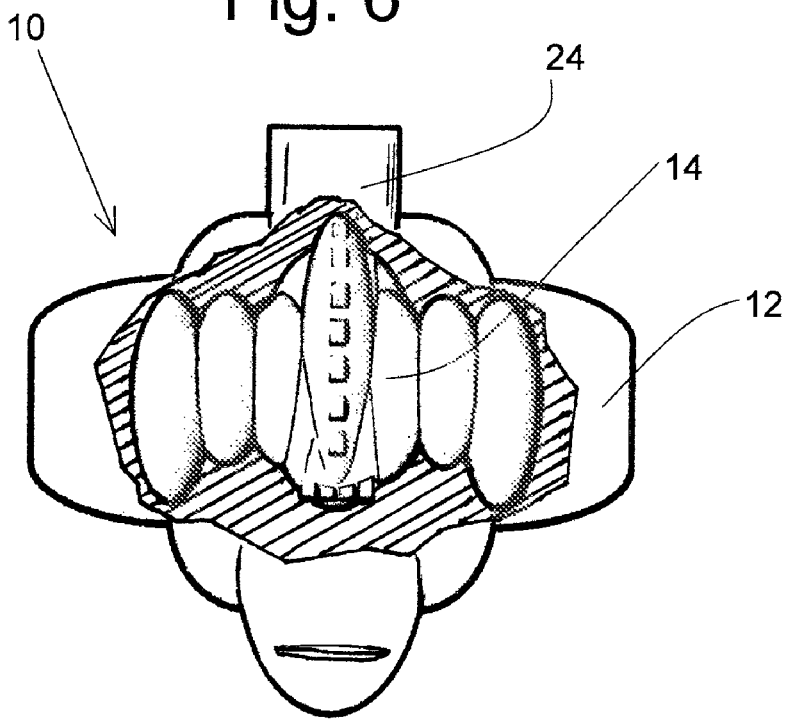
FIG. 6 is a top cutaway view of the layered eraser of FIG. 1 showing the intermediate layer and the innermost layer of the layered eraser.
Figure 7:
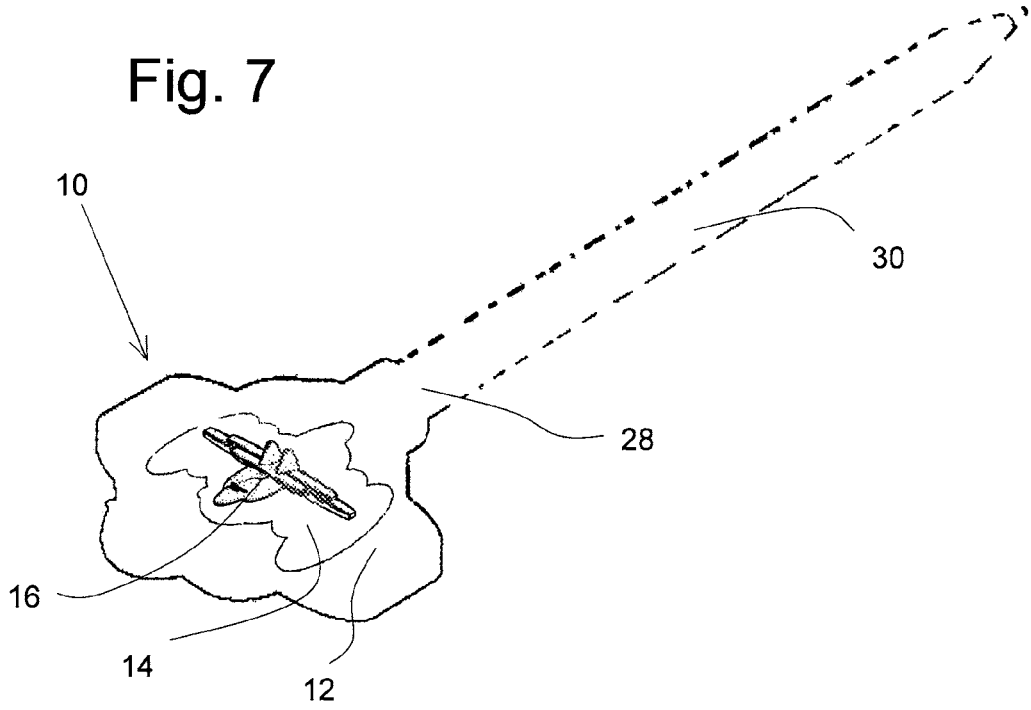
FIG. 7 is a perspective cutaway view of the layered eraser of FIG. 1 showing the innermost layer and showing the intermediate layer, the outermost layer, and the pencil of FIG. 1 in phantom.
Figure 8:
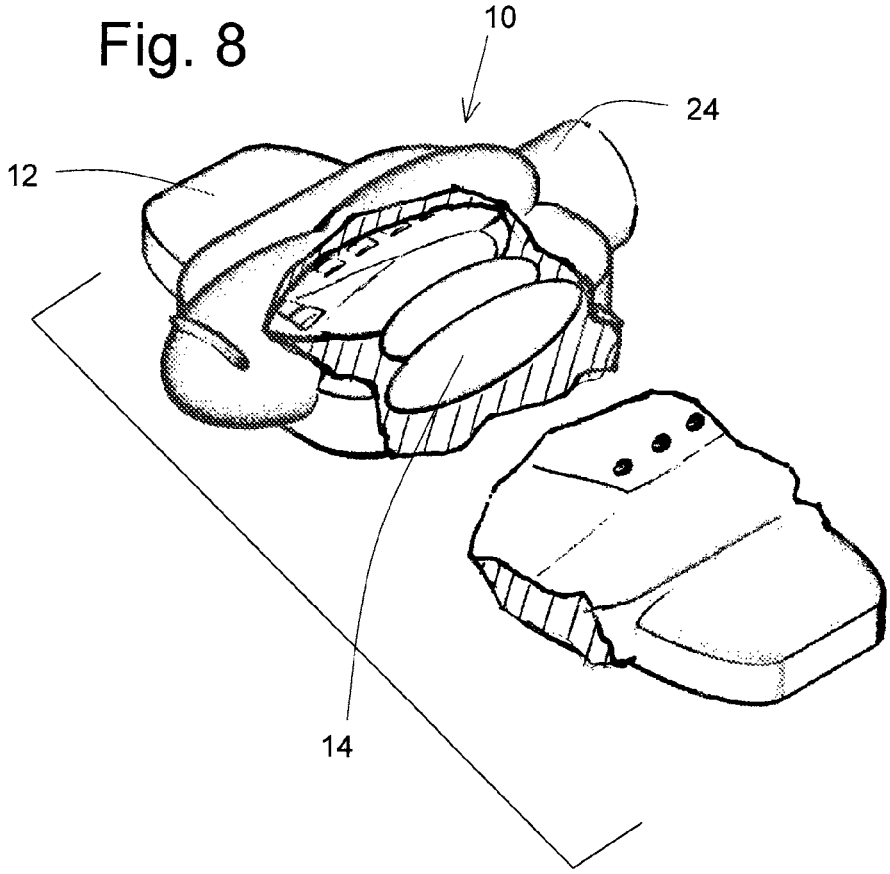
FIG. 8 is a perspective cutaway view of the layered eraser of FIG. 1 showing the intermediate layer of the layered eraser.
Figure 9:
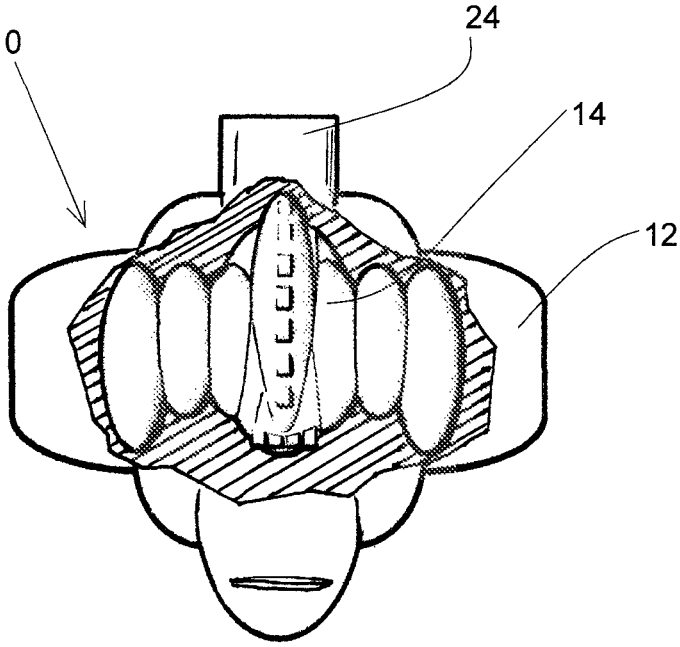
FIG. 9 is a top cutaway view of the layered eraser of FIG. 1 showing the intermediate layer of the layered eraser.
Figure 10:
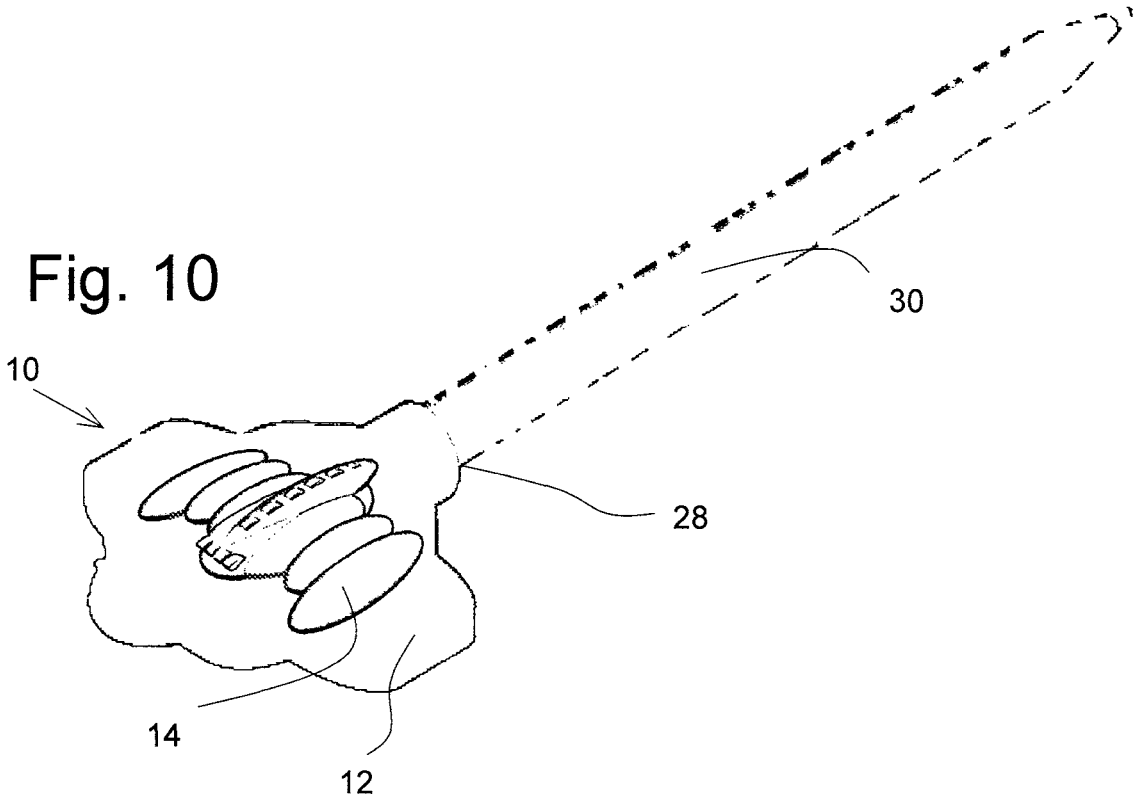
FIG. 10 is a perspective cutaway view of the layered eraser of FIG. 1 showing the intermediate layer and showing the outermost layer and the pencil of FIG. 1 in phantom.
Figure 11:
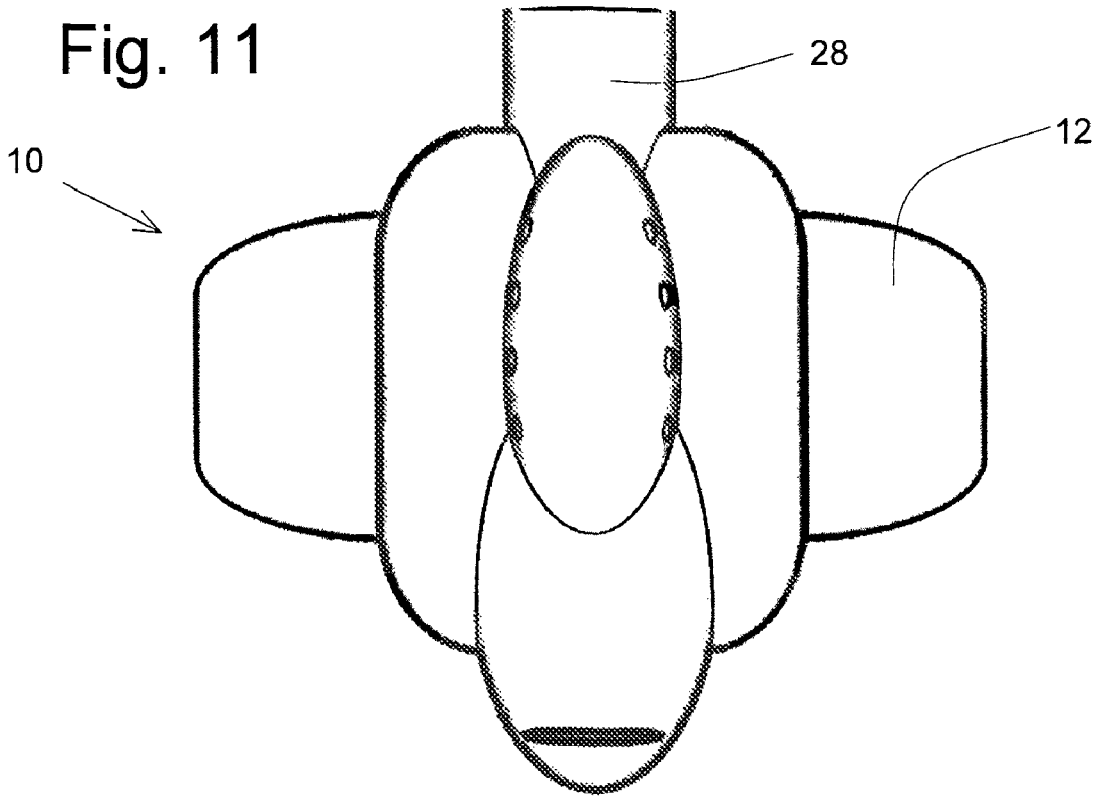
FIG. 11 is a top view of the layered eraser of FIG. 1, and, in particular, the outermost layer.
Figure 12:
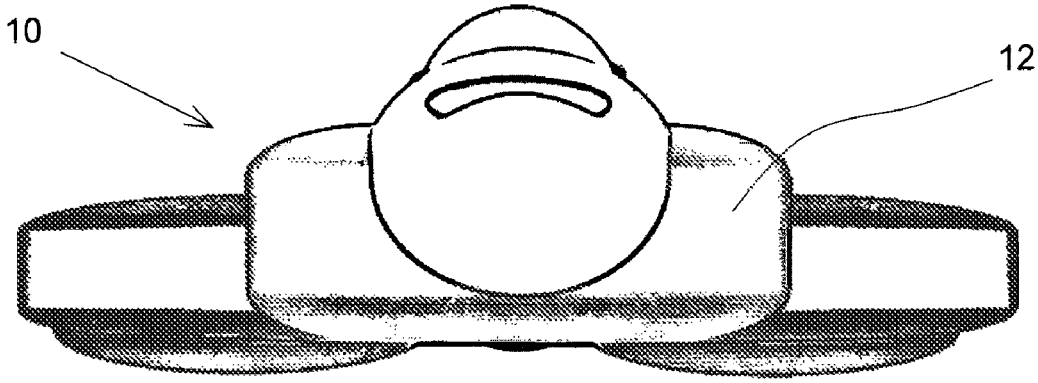
FIG. 12 is a front view of the layered eraser of FIG. 1 and, in particular, the outermost layer.
Figure 13:
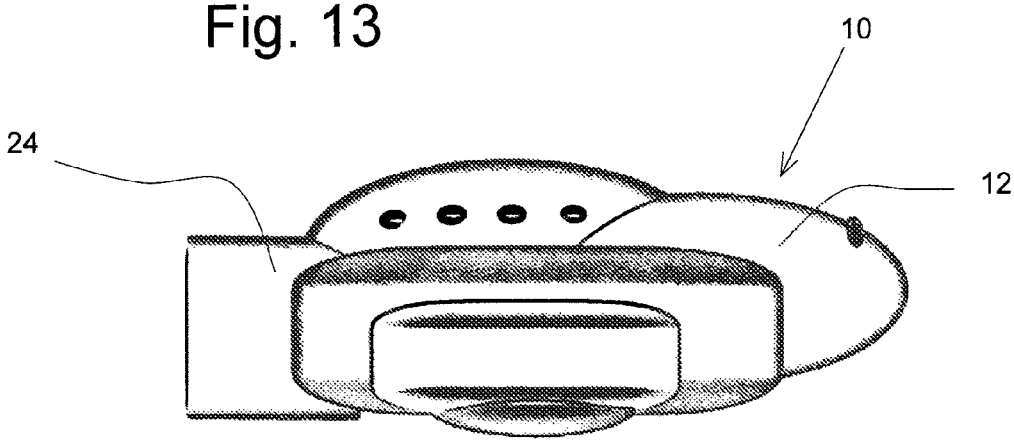
FIG. 13 is a side view of the layered eraser of FIG. 1 and, in particular, the outermost layer.
Figure 14:
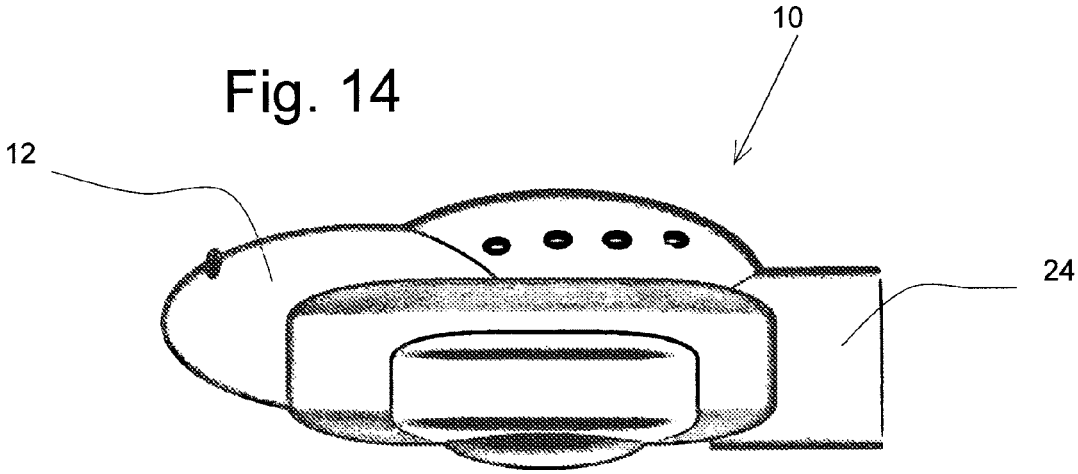
FIG. 14 is another side view of the layered eraser of FIG. 1 and, in particular, the outermost layer.
Figure 15:
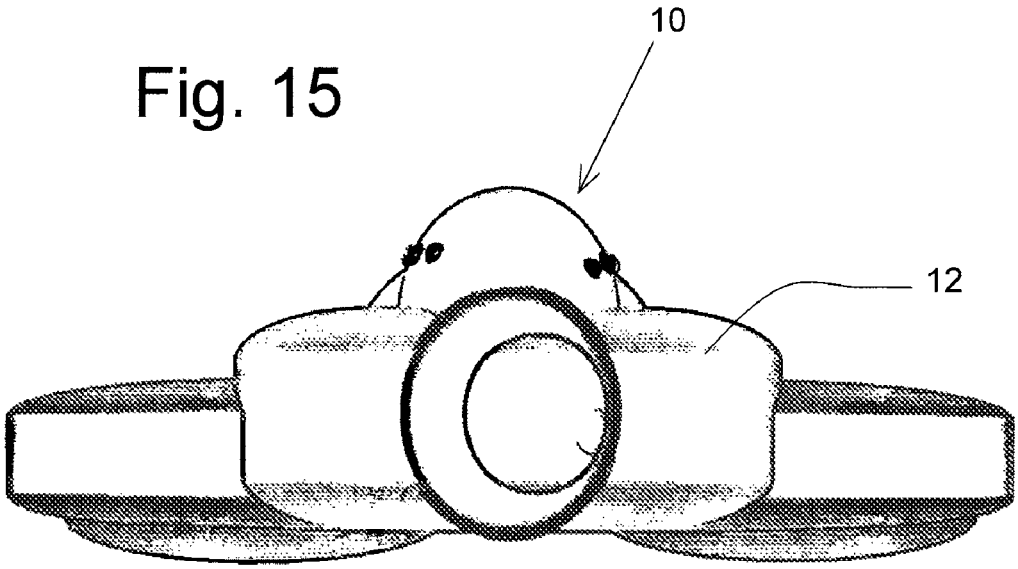
FIG. 15 is a rear view of the layered eraser of FIG. 1 and, in particular, the outermost layer.
Figure 16:
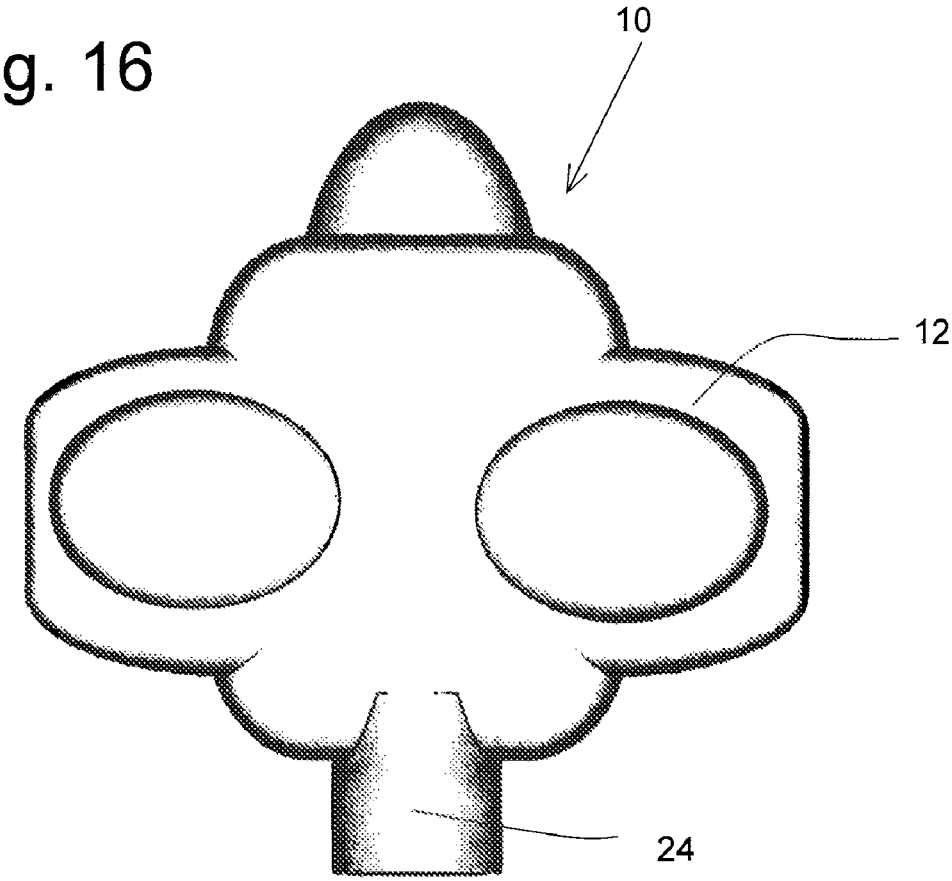
FIG. 16 is a bottom view of the layered eraser of FIG. 1 and, in particular, the outermost layer.
Figure 17:
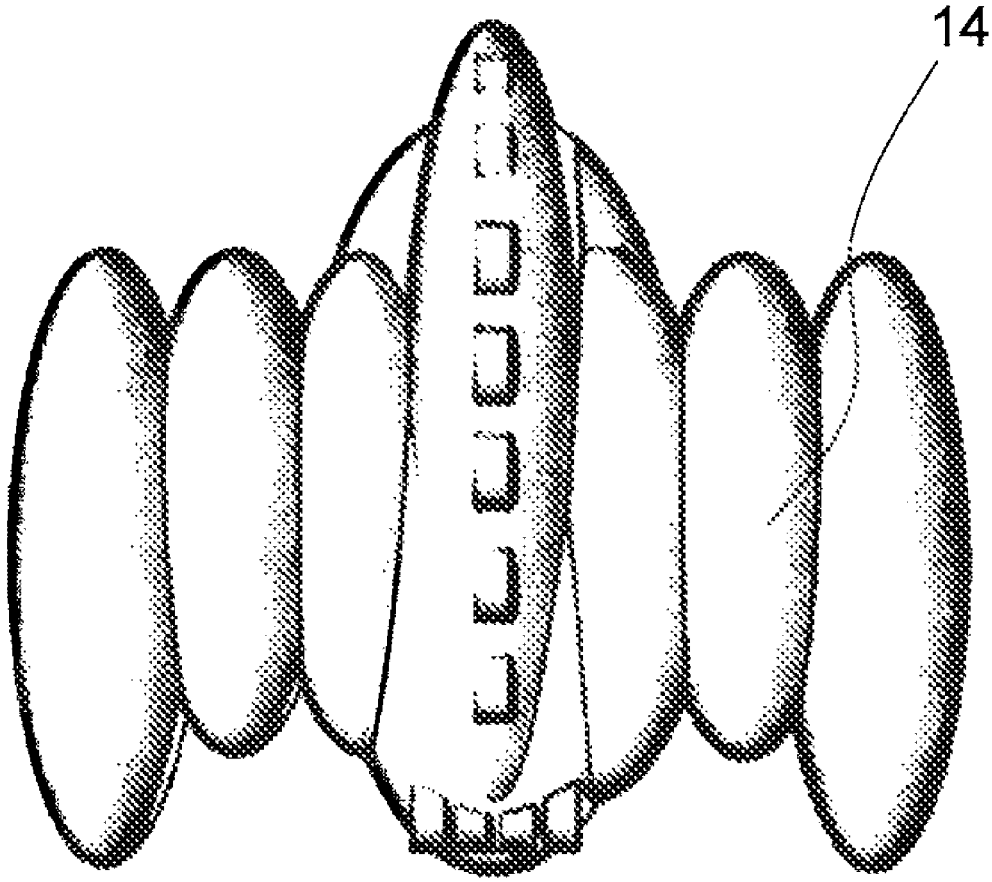
FIG. 17 is a top view of the intermediate layer of the layered eraser of FIG. 1.
Figure 18:
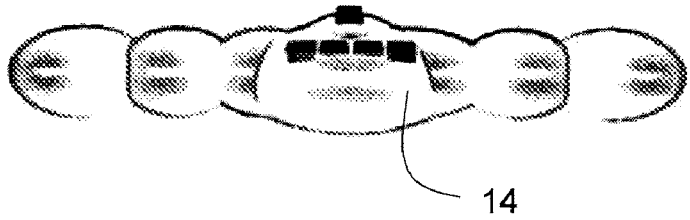
FIG. 18 is a front view of the intermediate layer of the layered eraser of FIG. 1.
Figure 19:
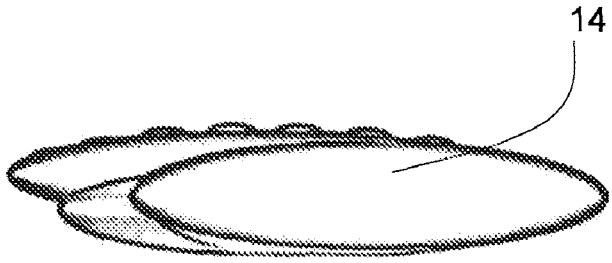
FIG. 19 is a side view of the intermediate layer of the layered eraser of FIG. 1.
Figure 20:
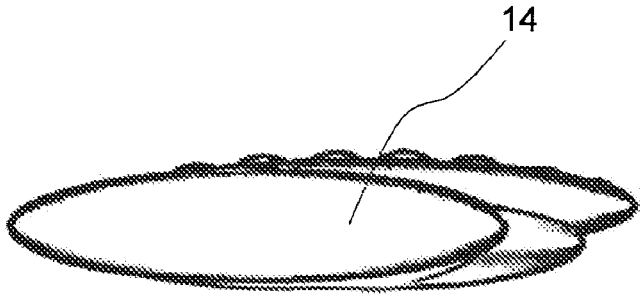
FIG. 20 is another side view of the intermediate layer of the layered eraser of FIG. 1.
Figure 21:
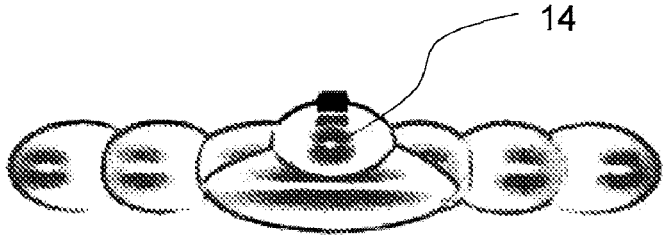
FIG. 21 is a rear view of the intermediate layer of the layered eraser of FIG. 1.
Figure 22:
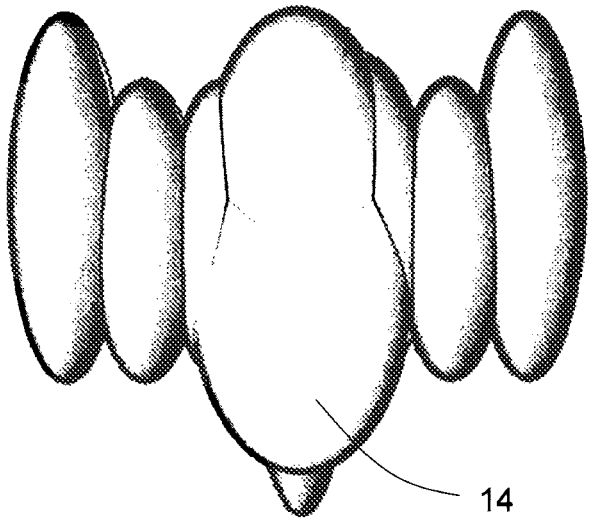
FIG. 22 is a bottom view of the intermediate layer of the layered eraser of FIG. 1.
Figure 23:
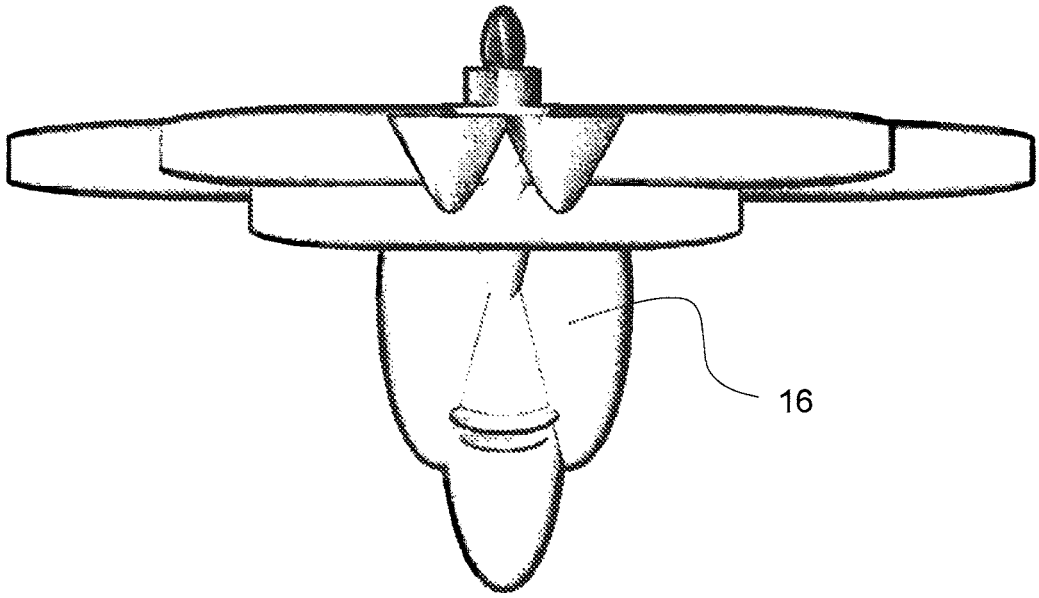
FIG. 23 is a top view of the innermost layer of the layered eraser of FIG. 1.
Figure 24:
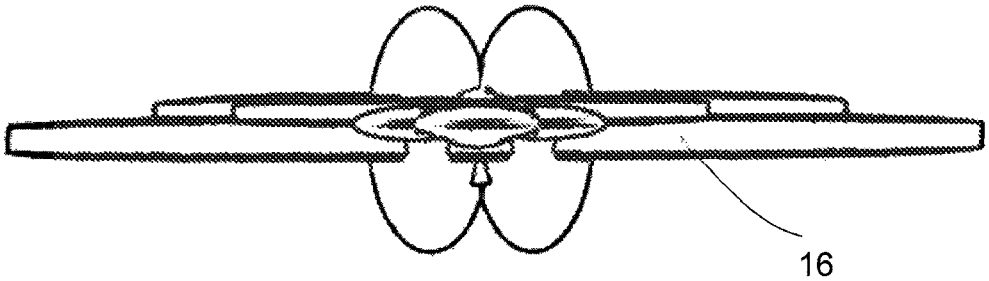
FIG. 24 is a front view of the innermost layer of the layered eraser of FIG. 1.
Figure 25:
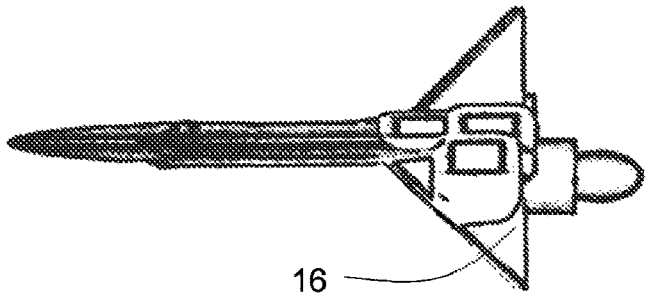
FIG. 25 is a side view of the innermost layer of the layered eraser of FIG. 1.
Figure 26:
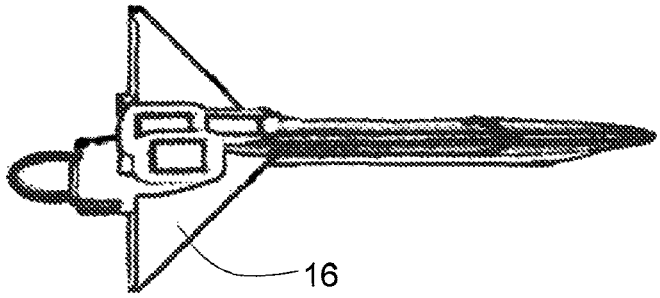
FIG. 26 is another side view of the innermost layer of the layered eraser of FIG. 1.
Figure 27:
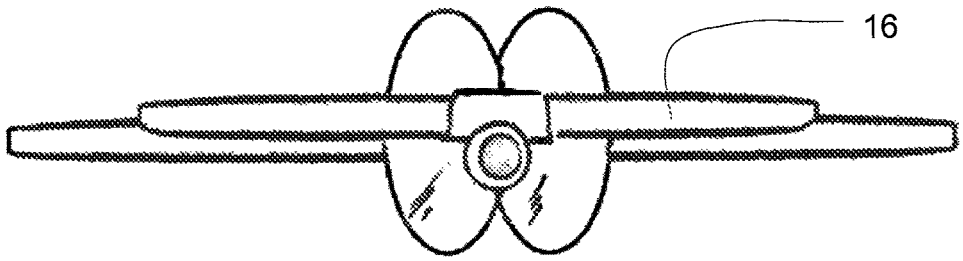
FIG. 27 is a rear view of the innermost layer of the layered eraser of FIG. 1.
Figure 28:
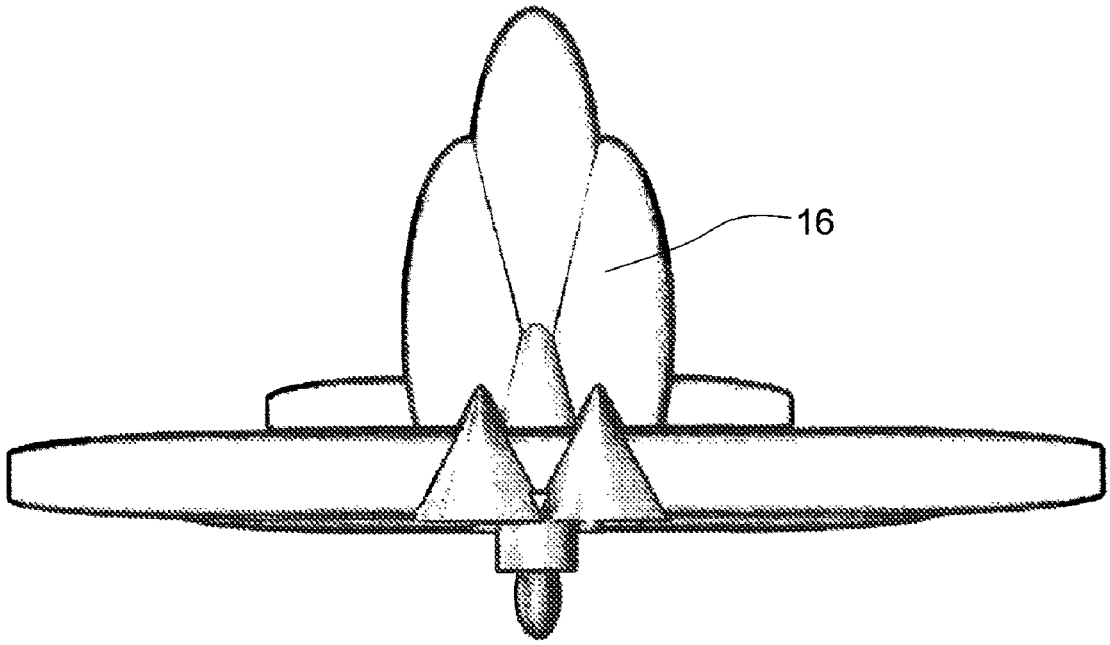
FIG. 28 is a bottom view of the innermost layer of the layered eraser of FIG. 1.

FIGS. 4 and 5 show the intermediate layer 14, having the shape of the second simulated space ship, and the innermost layer 16, having the shape of the third simulated space ship, respectively.

FIGS. 6-10 show various cutaway views of the layered eraser 10 showing the outermost layer 12, the intermediate layer 14, and the innermost layer 16, respectively.

FIGS. 11-16 show top, front, side, rear, and bottom views of the layered eraser 10, and, in particular, the outermost layer 12 having the shape of the first simulated space ship.

FIGS. 17-22 show top, front, side, rear, and bottom views of the intermediate layer 14 of the layered eraser 10 having the shape of the second simulated space ship.

FIGS. 23-28 show top, front, side, rear, and bottom views of the innermost layer 16 having the shape of the third simulated space ship.

The layered eraser 10 has a plurality of layers, and may also be referred to as a multi layered eraser or nested eraser, and is typically constructed of rubber, synthetic rubber, plastic or gum-like materials, synthetic soy-based gum, and may also contain vinyl and pulverized pumice, manmade material, natural material, other suitable materials, or any combination thereof that allow a user to erase a mark, such as a pencil mark, ink mark, the like, or indicia from a surface. As a user erases a mark, such as a pencil mark, ink mark, the like, or indicia from a surface, on or more different layers of the layered eraser 10 are exposed.

The layered eraser 10 may be used, for example, to erase pencil markings, ink, or other suitable marking, from paper, wood, metal, or a variety of other suitable surfaces, and reveal typically one, two, or more layers of the layered eraser 10, as the one or more of the layers of the layered eraser 10 are worn away, during each succeeding use.

The layered eraser 10 may be constructed of rubber, polyvinyl chloride synthetic rubber, other suitable material, or any combination thereof, which wears away from repeated erasures.

Users can elect to wear away a partial or full portion or portions of the layered eraser 10 to reveal a cross section of one or more layers, or erase around one entire layer at a time, ultimately revealing one or more, or as many layers as desired.

The layered eraser 10 may be mounted at the top of the pencil 30 or to cap the pencil 30 or a pen, or the layered eraser 10 may be used independently of the pencil 30, such as in a typical hand held eraser.

Alternative embodiments of the layered eraser 10 may be used, having different outermost layers, different intermediate layers, and different innermost layers, and having different outermost layer surfaces, different intermediate layer surfaces, and different innermost layer surface.

The layered eraser 10 and the alternative embodiments of the present invention may be used for instructional purposes, especially in those cases where such layered erasers show the outermost layer, intermediate layers, and innermost layers of real objects or other suitable objects, such as, for example, a dinosaur head, the Earth, a spaceship, an airplane, a boat, an automobile, anatomical studies of living organisms, superheroes whose costumes erase away to reveal secret identities, or other suitable objects, and/or may be used for enjoyment of children and/or adults alike, as well as for instructional purposes.

Each of the layered erasers has a plurality of layers, and typically exemplifies an object or objects within a class of objects. Each layer may have an attribute of a particular object, or each layer may be of a different object in a class of objects, or a combination thereof.

A class may be, for example, a cat; whereas, a particular cat, such as "Frisky" may be an object of the class cat. An object's attributes, may be, for example, Frisky's height, weight, and age.

Therefore, an alternative embodiment of the layered eraser 10 may be a dinosaur with each of the layers representing a different attribute of the dinosaur object Stegosaurus, such as, for example, the exterior, muscles, skeletal, and organs of the dinosaur Stegosaurus.

Alternatively, an alternative embodiment of the layered eraser 10 may have a plurality of layers with each of the layers representing a different dinosaur object, such as Tyrannosaurus, Plesiosaurus, and Brachiosaurus within the class dinosaur.

Alternative embodiments of the layered eraser 10 may alternatively have a combination of layers, some of which represent attributes of a particular dinosaur object or objects and others, which represent different dinosaur objects within the class dinosaur.

Alternative embodiments of the layered eraser 10 may represent a particular theme or themes in a story or other suitable types of themes, and, thus, be thematically based. The outermost layer 12, the intermediate layer 14, and the innermost layer 16 may, for example, be thematically based.

The innermost layer 16 or core of the layered eraser 10 may optionally be constructed of a wear resistant material, enabling the innermost layer 16 or core to remain in tact after the outermost layer 12 and/or the intermediate layer 14 of the layered eraser 10 are worn down. The innermost layer 16 or core of the layered eraser 10 and/or the innermost layer or core of any of the other alternative embodiments of the layered eraser 10 may, for example, be retained as a collectible item or toy or other suitable object for continued play or instructional purposes, after the eraser material of the intermediate layer 14 and the outermost layer 12 of the layered eraser 10 or the other alternative embodiments are worn away.

The layered eraser 10, the multi-layered eraser, or the nested eraser, or other suitable alternative embodiments may be accompanied with a fact sheet, such as, for example, an Astronomy Factoid card with facts about space and space travel that may accompany a multi layered eraser space ship and/or multi-layered planet. The fact sheets or cards may contain the name or names of the simulated space ship or space ships, their missions and crew compliments.

The layered eraser 10 may have a toy and/or prize or other suitable object inside the layered eraser 10. The object, toy, and/or prize may be of plastic, polyvinylchloride, thermoplastics, thermosetting polymers, rubber, metal, wood, or other suitable material or combination thereof. The innermost layer 16 or core of the layered eraser 10 or any of the embodiments of the present invention may comprise a suitable object, the toy and/or prize, or the innermost layer 16 or core may have a container therein for housing the object, toy and/or prize, or the innermost layer 16 or core may have the object, toy and/or prize embedded therein or encapsulated therein. Other suitable means may also be used to contain a suitable object, the toy and/or prize in one or more layers of the layered eraser 10 and/or any of the embodiments of the present invention.

The innermost layer 16 or core of the layered eraser 10 may alternatively and/or additionally be of plastic, polyvinylchloride, thermoplastics, thermosetting polymers, rubber, metal, wood, or other suitable material or combination thereof.

The layered eraser 10 has at least one layer of the plurality of layers completely surrounding one or more of the other layers of the layered eraser 10. One or more layers of the plurality of layers is then exposed after at least one use and after at least a portion of the outermost layer 12 of the layered eraser 10 is worn away.

Alternatively, other embodiments of the present invention include one or more layers partially surrounded by one or more other layers.

FIGS. 29-33 show an alternate embodiment of a layered eraser 50, which is substantially the same as the layered eraser 10, except that the layered eraser 50 is of a globe simulating the Earth, a planet, a moon, or other astronomical object.

The layered eraser 50 has an outermost layer 52, an intermediate layer 54, and an innermost layer 56. The outermost layer 52, the intermediate layer 54, and the innermost layer 56 are each in the form of different simulated portions of, for example, the Earth. The outermost layer 52 of the layered eraser 50 has outermost layer surface 58 having the shape of the Earth's crust; the intermediate layer 54 of the layered eraser 50 has intermediate layer surface 60 having the shape of the Earth's mantel; and the innermost layer 56 of the layered eraser 50 has innermost layer surface 62 having the shape of the Earth's core. The innermost layer 56 is nested within the intermediate layer 54, and the intermediate layer 54 is nested within the outermost layer 52.

The layered eraser 50 has substantially cylindrical end portion 64 and substantially cylindrical chamber 66 for optionally receiving top portion 68 of pencil 70 therein and mounting on the pencil 70. The substantially cylindrical end portion 64 and/or the substantially cylindrical chamber 66 may have other suitable shapes for mounting to the top of the pencil 70. Alternatively, the substantially cylindrical end portion 64 of the layered eraser 50 may be adapted to fit into or on top of other suitable or alternative pencils.

The layered eraser 50, the plurality of layers, and portions of the plurality of layers may be of different colors to simulate the Earth's crust. Land masses may, for example, be shown in green and bodies of water in blue. The innermost layer 56 may, for example, be yellow to simulate the Earth's Inner Core. The intermediate layer 54 may, for example, be orange to simulate the Earth's Outer Core. The outermost layer 52 may, for example, be red to simulate the Earth's Mantle.

A process for nesting multiple thematically coordinated molds with differing designs and pigments may be used to create the layered erasers, multi layered erasers, and/or nested erasers.

FIGS. 34-37 show steps of a process for fabricating the layered eraser 50. FIG. 34 shows the pouring of liquid material 80 into mold portion 82. FIG. 35 shows a mold 84 that may be used to fabricate the layered eraser 50. The mold 84 has the mold portions 82. FIG. 36 shows a device for nesting different layers of the layered eraser 50 and, in particular, an armature 86 or framework around which the layered eraser 50 may be fabricated. FIG. 37 shows the outermost layer 52 of the layered eraser 50 being fabricated about the intermediate layer 54 of the layered eraser 50.

The process for fabricating the layered eraser 50 may be used for fabricating a variety of alternative layered erasers, multi layered erasers, and nested erasers, or other suitable processes may be used to fabricate the layered eraser 50 and/or to fabricate other suitable alternative embodiments.

FIGS. 38-42 show an alternate embodiment of a layered eraser 90, which is substantially the same as the layered eraser 10, except that the layered eraser 90 is of a simulated dinosaur head and, in particular, a simulated T-Rex dinosaur head.

The layered eraser 90 is shown mounted on a portion of a pencil 92 in FIG. 38 showing mouth portion 93 of the layered eraser 90 worn away, which is discussed in more detail later. FIGS. 39-42 show different layers of the layered eraser 90. FIG. 39 shows outermost layer 94 of the layered eraser 90, which represents the epidermis layer of the T-Rex dinosaur head, and which may also be called the epidermis layer of the layered eraser 90. FIG. 40 shows first intermediate layer 96, which represents the musculature layer of the T-Rex dinosaur head, and which may also be called the musculature layer of the layered eraser 90. FIG. 41 shows second intermediate layer 98, which represents the skeletal layer of the T-Rex dinosaur head, and which may also be called the skeletal layer of the layered eraser 90. FIG. 42 shows innermost layer 100, which represents the brain layer of the T-Rex dinosaur head, and which may also be called the brain layer of the layered eraser 90.

The layered eraser 90, the plurality of layers, and portions of the plurality of layers may be of different colors to simulate the T-Rex dinosaur head. The outermost layer 94 of the layered eraser 90, which represents the epidermis layer of the T-Rex dinosaur head, may, for example, have a variety of colors and be full color erasable pigments. The first intermediate layer 96, which represents the musculature layer of the T-Rex dinosaur head may, for example, be different shades of pink. The second intermediate layer 98, which represents the skeletal layer of the T-Rex dinosaur head, may, for example, be white and pink, but may alternatively be translucent. The innermost layer 100, which represents the brain layer of the T-Rex dinosaur head, may be, for example, grey and pink.

The outermost layer 94 of the layered eraser 90, which represents the epidermis layer of the T-Rex dinosaur head, the first intermediate layer 96, which represents the musculature layer of the T-Rex dinosaur head, and the second intermediate layer 98, which represents the skeletal layer of the T-Rex dinosaur head are shown as having been worn away at the mouth portion 93 of the layered eraser 90 in FIG. 38.

FIGS. 43-48 show an alternate embodiment of a layered eraser 110, which is substantially the same as the layered eraser 10, except that the layered eraser 110 is of another simulated dinosaur head and, in particular, a simulated Triceratops dinosaur head.

FIG. 43 shows the layered eraser 110 having the shape of the simulated Triceratops dinosaur head. FIG. 44 shows the layered eraser 110 mounted on a portion of a pencil 111.

FIG. 45 shows the layered eraser 110 having an outermost layer 112, an intermediate layer 114, and an innermost layer 116. The outermost layer 112, the intermediate layer 114, and the innermost layer 116 are each in the form of different layers of the simulated Triceratops dinosaur head. The outermost layer 112 of the layered eraser 110 has outermost layer surface 118 having the shape of a first simulated Triceratops dinosaur head layer; the intermediate layer 114 of the layered eraser 110 has intermediate layer surface 120 having the shape of a second simulated Triceratops dinosaur head layer; and the innermost layer 116 of the layered eraser 110 has innermost layer surface 122 having the shape of a third simulated Triceratops dinosaur head layer. The innermost layer 116 is nested within the intermediate layer 114, and the intermediate layer 114 is nested within the outermost layer 112.

The layered eraser 110 has end portion 124 and substantially cylindrical chamber 126 for optionally receiving top portion 128 of the pencil 111 therein and mounting on the pencil 111. The end portion 124 and/or the substantially cylindrical chamber 126 may have other suitable shapes for mounting to the top of the pencil 111. Alternatively, the substantially cylindrical end portion 124 of the layered eraser 110 may be adapted to fit into or on top of other suitable or alternative pencils.

FIGS. 46-48 show the outermost layer 112, the intermediate layer 114, and the innermost layer 116 of the layered eraser 110, respectively.

FIGS. 49-56 show an alternate embodiment of a layered eraser 130, which is substantially the same as the layered eraser 10, except that the layered eraser 130 is of a simulated dog in a simulated carrying case. FIGS. 49-56 show perspective, exploded, front, top, side, rear, and bottom views of the layered eraser 130 of a simulated dog 132 in a simulated carrying case 134 mounted on pencil 136.

The simulated dog 132 is partially surrounded by the simulated carrying case 134. The simulated dog 132 may optionally be of eraser material similar to that of the simulated carrying case 134, or the simulated dog 132 may, for example, be of a substantially harder material than that of the simulated carrying case 134, in which case the simulated dog 132 may remain in tact and be saved as a toy and/or prize or object after the simulated carrying case 134 is worn away. Plastic, polyvinylchloride, thermoplastics, thermosetting polymers, rubber, metal, wood, or other suitable material or combination thereof may be used, which allow the simulated dog 132 to remain in tact and to be used as a toy and/or a prize.

Although the present invention has been described in considerable detail with reference to certain preferred versions thereof, other versions are possible. Therefore, the spirit and scope of the appended claims should not be limited to the description of the preferred versions contained herein.

What is claimed is:

1. A layered eraser, comprising:

a plurality of eraser layers, comprising at least an innermost eraser layer and an outermost eraser layer;

said outermost eraser layer containing and completely encasing said innermost eraser layer prior to a portion of said outermost layer being worn away and exposing a portion of said innermost layer;

each eraser layer of said plurality of eraser layers adjacent at least one other said eraser layer;

each said eraser layer having an outermost surface.

2. The layered eraser according to claim 1, wherein:

said layered eraser is adapted to fit about a writing instrument.

3. The layered eraser according to claim 1, wherein:

each said eraser layer adjacent said at least one other eraser layer has a different shaped said outermost surface.

4. The layered eraser according to claim 2, wherein:

each said eraser layer adjacent said at least one other eraser layer has a different shaped said outermost surface.

5. The layered eraser according to claim 3, wherein:

each said different shaped said outermost surface is thematically based.

6. The layered eraser according to claim 3, wherein:

each said different shaped said outermost surface has the shape of a different simulated space ship.

7. The layered eraser according to claim 3, wherein:

each said different shaped said outermost surface has the shape of a different simulated dinosaur head.

8. The layered eraser according to claim 3, wherein:

each said different shaped said outermost surface has the shape of a different simulated planet.

9. The layered eraser according to claim 1, wherein:

said layered eraser has an object embedded within said layered eraser.

10. A layered eraser, comprising:

a plurality of eraser layers, comprising at least an innermost eraser layer and an outermost eraser layer;

said outermost eraser layer completely surrounding all of said innermost eraser layer prior to a portion of said outermost layer being worn away and exposing a portion of said innermost layer;

each eraser layer of said plurality of eraser layers adjacent at least one other said eraser layer;

each said eraser layer having an outermost surface.

11. The layered eraser according to claim 10, wherein:

said layered eraser is adapted to fit about a writing instrument.

12. The layered eraser according to claim 10, wherein:

each said eraser layer adjacent said at least one other eraser layer has a different shaped said outermost surface.

13. The layered eraser according to claim 11, wherein:

each said eraser layer adjacent said at least one other eraser layer has a different shaped said outermost surface.

14. The layered eraser according to claim 12, wherein:

each said different shaped said outermost surface is thematically based.

15. The layered eraser according to claim 12, wherein:

each said different shaped said outermost surface has the shape of a different simulated space ship.

16. The layered eraser according to claim 12, wherein:

each said different shaped said outermost surface has the shape of a different simulated dinosaur head.

17. The layered eraser according to claim 12, wherein:

each said different shaped said outermost surface has the shape of a different simulated planet.

18. The layered eraser according to claim 10, wherein:

said layered eraser has an object embedded within said layered eraser.

19. A layered eraser, comprising:

a plurality of eraser layers, comprising an innermost eraser layer, at least one intermediate eraser layer, and an outermost eraser layer;

said outermost eraser layer completely surrounding said at least one intermediate eraser layer prior to a portion of said outermost layer being worn away and exposing a portion of said at least one intermediate eraser layer;

said at least one intermediate eraser layer completely surrounding said innermost eraser layer;

each eraser layer of said plurality of eraser layers adjacent at least one other said eraser layer;

each said eraser layer having an outermost surface.

20. The layered eraser according to claim 19, wherein:

said layered eraser is adapted to fit about a writing instrument.

21. The layered eraser according to claim 19, wherein:

each said eraser layer adjacent said at least one other eraser layer has a different shaped said outermost surface.

22. The layered eraser according to claim 20, wherein:

each said eraser layer adjacent said at least one other eraser layer has a different shaped said outermost surface.

23. The layered eraser according to claim 21, wherein:

each said different shaped said outermost surface is thematically based.

24. The layered eraser according to claim 21, wherein:

each said different shaped said outermost surface has the shape of a different simulated space ship.

25. The layered eraser according to claim 21, wherein:

each said different shaped said outermost surface has the shape of a different simulated dinosaur head.

26. The layered eraser according to claim 21, wherein:

each said different shaped said outermost surface has the shape of a different simulated planet.

27. The layered eraser according to claim 19, wherein:

said layered eraser has an object embedded within said layered eraser.

28. A layered eraser, comprising:

a plurality of eraser layers, comprising an innermost eraser layer, at least one intermediate eraser layer, and an outermost eraser layer;

said outermost eraser layer completely surrounding said at least one intermediate eraser layer prior to a portion of said outermost layer being worn away and exposing a portion of said at least one intermediate eraser layer;

said at least one intermediate eraser layer completely surrounding said innermost eraser layer prior to a portion of said at least one intermediate eraser layer being worn away and exposing a portion of said innermost eraser layer;

each eraser layer of said plurality of eraser layers adjacent at least one other said eraser layer;

each said eraser layer having an outermost surface.

* * * * *